US008037564B2

(12) United States Patent
Satoh et al.

(10) Patent No.: US 8,037,564 B2
(45) Date of Patent: Oct. 18, 2011

(54) AIR CELL UNIT AND CUSHION

(75) Inventors: Hajime Satoh, Hiratsuka (JP); Hiromi Sanada, Tokyo (JP)

(73) Assignees: The Yokohama Rubber Co., Ltd., Tokyo (JP); The University of Tokyo, Tokyo (JP)

( * ) Notice: Subject to any disclaimer, the term of this patent is extended or adjusted under 35 U.S.C. 154(b) by 104 days.

(21) Appl. No.: 11/999,621

(22) Filed: Dec. 5, 2007

(65) Prior Publication Data

US 2009/0144906 A1 Jun. 11, 2009

(51) Int. Cl.
*A47C 17/00* (2006.01)

(52) U.S. Cl. ..... 5/723; 5/655.3; 5/710; 5/713

(58) Field of Classification Search ..... 5/655.3, 5/706, 710, 713, 722, 723; 297/284.6, 452.41
See application file for complete search history.

(56) References Cited

U.S. PATENT DOCUMENTS

| | | | | |
|---|---|---|---|---|
| 5,379,471 | A * | 1/1995 | Holdredge | 5/655.3 |
| 5,640,731 | A * | 6/1997 | Toedter | 5/713 |
| 5,745,941 | A * | 5/1998 | Miller, Sr. | 5/710 |
| 6,014,783 | A * | 1/2000 | Collier et al. | 5/618 |
| 6,519,797 | B1 * | 2/2003 | Brubaker et al. | 5/654 |
| 6,715,174 | B2 * | 4/2004 | Tsai | 5/709 |

FOREIGN PATENT DOCUMENTS

| | | |
|---|---|---|
| JP | A 8-503152 | 4/1996 |
| JP | A 2002-320535 | 11/2002 |
| JP | A 2003-159286 | 6/2003 |
| JP | A 2004-33329 | 2/2004 |

* cited by examiner

*Primary Examiner* — Robert G Santos
*Assistant Examiner* — Nicholas Polito
(74) *Attorney, Agent, or Firm* — Greer, Burns & Crain, Ltd.

(57) ABSTRACT

The air cells are attached detachably to the base members. By this, it is possible to set up the size or the arrangement of the air cells. For example, in a hospital, it is possible to change easily and inexpensively the air cells on a bed according to the patient's height, the body shape, the state, or the condition of affected part. Thus, it is exceedingly advantageous for dispersing the pressure added to the body.

23 Claims, 20 Drawing Sheets

AIR CELL UNIT AND CUSHION

BACKGROUND OF THE INVENTION (i) Field of the Invention

The present invention relates to, for example, an air cell unit and cushion which is having a plurality of air cells disposed in some flat direction on a bed of a hospital or on a wheelchair and which is used for preventing occurrence of a bedsore on a patient.

(ii) Description of the Related Art

A generally known cushion comprises a plurality of air cells disposed in some flat direction and being capable of housing air respectively, and a ventilation passage for connecting the interiors of the air cells each other and equalizing the air pressures in the air cells. Said cushion disperses the pressure being exerted on the body on the air cells and prevents occurrence of a bedsore.

By the way, above mentioned cushion with air cells is composed of a upper sheet-like member formed integrally with a plurality of air cells and a bottom sheet-like member having area equivalent to the upper sheet-like member. The upper sheet-like member has the area according to the size of the bed and is made from flexible material such as rubber material or resin material. The bottom sheet-like member is pasted to the undersurface of the upper sheet-like member, and the opening portion of each air cell bottom is closed by the bottom sheet-like member. Also, the ventilation passage for making the insides of the air cells communicate each other is disposed between those sheet-like members.

In this case, it is desirable to respectively set up the size and the arrangement of the air cells according to the patient's height, body shape, or the state and condition of the affected part in order to disperse more effectively the pressure being added to the body.

However, in the above-mentioned cushion, it is necessary to change the shape of a upper sheet-like member in order to change the size and arrangement of air cells. Also, since the air cells of the upper sheet-like member are molded by a plurality of concave portions or convex portions of the metallic mold, a plurality of metallic molds are needed according to the number of the kind of upper sheet-like member. Namely, it is impossible to change the size and arrangement of the air cells according to the patient's height, body shape, or the state and condition of the affected part.

Also, in order to disperse the pressure added to the body, it is desirable that air cells are flexible. However, the flexible air cell tends to generate an air leak by breakage. Also, since air cells communicate with each other by a ventilation passage, other non-breakage air cells are influenced by breakage of some air cells. Therefore, when the air cell is damaged, it is necessary to perform repair of a breakage part, or exchange the cushion itself. By this, in repair of a breakage part, time and effort is taken, and when it is the exchange of the cushion itself, expense costs dearly.

Moreover, in order to keep air cells always clean, it is desirable to use respectively a new cushion for every patient in a hospital. However, since much expense is needed to purchase cushions for every patient respectively, under the present circumstances, the cushion is washed and used repeatedly. In this case, the air cells are flexible and breakable, and it is difficult to wash a plurality of air cells being disposed each other. By this, it is impossible to wash the air cells fully.

SUMMARY OF THE INVENTION

An object of the present invention is to provide an air cell unit and cushion changable easily and inexpensively in the size of the air cells or the arrangement of the air cells, repairable easily and inexpensively at the time of breakage of the air cell, and capable of keeping the air cells clean always.

In order to achieve the above object, in the present invention, a cushion is provided with a plurality of air cells formed to a bag-like shape and being capable of housing air, the air cells having at least one opening portion respectively and having flexibility, a plurality of protrusion portions arranged in a certain plane surface direction, the protrusion portion having an outer surface to which a opening end part of the air cell is detachably attached by fitting so that the air cells are arranged in the certain plane surface direction, a air passage for sucking/exhausting air in the air cells, which are being attached to the protrusion portions, via the opening portions of the air cells.

Thus, by using two or more kinds of the air cells from which a size differs, it is possible to set up arbitrarily sizes of air cells which are provided so as to be disposed in the certain plane surface direction. By this, for example at a hospital, it is possible to change the size of the air cells easily and inexpensively according to the patient's height, body shape, or the state and condition of the affected part. It is exceedingly advantageous for dispersing effectively the pressure added on a patient's body.

Moreover, the air cells are being attached to the protrusion portions detachably. By this, when breakage arises on some air cells among the air cells, it is possible to change only the broken air cells. Thus, it is possible to repair the air cells easily and inexpensively.

Also, the air cells are being attached to the protrusion portions detachably. By this, it is possible to remove each air cell and to wash each air cell respectively, and it is possible to exchange some air cells for new air cells. By this, for example at a hospital, washing of the air cells becomes easy, and it is possible to exchange some air cells for new air cells according to the state of the air cells. Thus, it is exceedingly advantageous for keeping the air cells clean always.

In order to achieve the above object, in the present invention, a air cell unit is provided with an air cell formed to a bag-like shape and being capable of housing air, the air cell having at least one opening portion and having flexibility, a base member having a board-like shape, a protrusion portion provided on one thickness-direction surface of the base member so as to protrude from one thickness-direction surface of the base member, the protrusion portion having outer surface on which a opening end part of the air cell is detachably attached by fitting, a projection portion and/or recessed portion provided on an end portion in the direction perpendicular to the thickness direction of the base member, the projection portion and/or a recessed portion for connecting the base member and another base member by being formed so as to connect with the projection portion and/or the recessed portion of another base member when the base member and another base member are disposed on a flat direction so that their end portions in the direction perpendicular to the thickness direction come close each other, and a air passage provided in the base member, the air passage for sucking/exhausting air in the air cell which is being attached to the base member via the opening portion, the air passage capable of connecting with the air passage of another base member.

Thus, the base member is connected with another base member and disposed on some flat surface. Also, the air cell is detachably attached to each base member respectively. The air passages of the base members are capable of communicating each other. By this, it is possible to dispose a plurality of air cells in some flat direction and make the insides of the air cells connect each other.

At this time, arrangement of the air cells can be arbitrarily set up by arrangement of the base members. Also, by using two or more kind of the air cells from which a size differs, it is possible to set up arbitrarily size of air cells which are provided so as to be disposed in the some flat direction. By this, for example at a hospital, it is possible to change the size or the arrangement of the air cells easily and inexpensively according to the patient's height, body shape, or the state and condition of the affected part. It is exceedingly advantageous for dispersing effectively the pressure added on a patient's body.

Moreover, the air cells are being attached on the base members detachably. By this, when breakage arises on some air cells among the air cells, it is possible to change only the broken air cells. Thus, it is possible to repair the air cells easily and inexpensively.

Also, the air cells are being attached on the base members detachably. By this, it is possible to remove each air cell and to wash each air cell respectively, and it is possible to exchange some air cells for new air cells. By this, for example at a hospital, washing of the air cells becomes easy, and it is possible to exchange some air cells for new air cells according to the state of the air cells. Thus, it is exceedingly advantageous for keeping the air cells clean always.

In order to achieve the above object, in the present invention, a cushion is provide with a plurality of air cells formed to a bag-like shape and being capable of housing air respectively, the air cells having at least one opening portion respectively and having flexibility, a plurality of base members formed board-like shape, a protrusion portion provided on each of base member respectively, the protrusion portion provided on one thickness-direction surface of the base member so as to protrude from one thickness-direction surface of the base member, the protrusion portion having outer surface on which a opening end part of the air cell is detachably attached respectively by fitting, an installation plate having larger area than the base member, a plurality of first connecting portions provided on one thickness-direction surface of the installation plate, a second connecting portion provided on each of the base member respectively, the second connecting portion for detachably attaching the base member to installation plate by connecting with the first connecting portions, a air passage provided on each of the base member respectively, the air passage for sucking/exhausting air in the air cell which is being attached to the base member via the opening portion, and the air passage capable of connecting with the air passage of another base member.

Thus, the base members are detachably attached to the installation plate, and the air cell is detachably attached to each base member respectively. Also, It is possible to attach plural air cell attached base members to the installation plate, and to connect the air passages of the base members each other. By this, it is possible to dispose a plurality of air cells in some flat direction and make the insides of the air cells connect each other.

At this time, arrangement of the air cells can be arbitrarily set up by arrangement of the base members. Also, by using two or more kind of the air cells from which a size differs, it is possible to set up arbitrarily size of air cells which are provided so as to be disposed in the some flat direction. By this, for example at a hospital, it is possible to change the size or the arrangement of the air cells easily and inexpensively according to the patient's height, body shape, or the state and condition of the affected part. It is exceedingly advantageous for dispersing effectively the pressure added on a patient's body.

Moreover, the air cells are being attached on the base members detachably. By this, when breakage arises on some air cells among the air cells, it is possible to change only the broken air cells. Thus, it is possible to repair the air cells easily and inexpensively.

Also, the air cells are being attached on the base members detachably. By this, it is possible to remove each air cell and to wash each air cell respectively, and it is possible to exchange some air cells for new air cells. By this, for example at a hospital, washing of the air cells becomes easy, and it is possible to exchange some air cells for new air cells according to the state of the air cells. Thus, it is exceedingly advantageous for keeping the air cells clean always.

In order to achieve the above object, in the present invention, a cushion is provide with a plurality of air cells formed to a bag-like shape and being capable of housing air respectively, the air cells having at least one opening portion respectively and having flexibility, a plurality of base members formed board-like shape, an installation plate having larger area than the base member, a plurality of through-holes provided on the installation plate so as to penetrate the installation plate in thickness-direction, the through-holes capable of detachably attaching the base members to installation plate respectively by inserting a part of the base member from one thickness-direction surface side to the other thickness-direction surface side of the installation plate and by fitting with said part of the base member, a air passage provided on each of the base member respectively, the air passage for sucking/exhausting air in the air cell which is being attached to the base member via the opening portion, the air passage capable of connecting with the air passage of another base member.

Thus, the base members are detachably attached to the installation plate, and the air cell is detachably attached to each base member respectively. Also, It is possible to attach plural air cell attached base members to the installation plate, and to connect the air passages of the base members each other. By this, it is possible to dispose a plurality of air cells in some flat direction and make the insides of the air cells connect each other.

At this time, arrangement of the air cells can be arbitrarily set up by arrangement of the base members. Also, by using two or more kind of the air cells from which a size differs, it is possible to set up arbitrarily size of air cells which are provided so as to be disposed in the some flat direction. By this, for example at a hospital, it is possible to change the size or the arrangement of the air cells easily and inexpensively according to the patient's height, body shape, or the state and condition of the affected part. It is exceedingly advantageous for dispersing effectively the pressure added on a patient's body.

Moreover, the air cells are being attached on the base members detachably. By this, when breakage arises on some air cells among the air cells, it is possible to change only the broken air cells. Thus, it is possible to repair the air cells easily and inexpensively.

Also, the air cells are being attached on the base members detachably. By this, it is possible to remove each air cell and to wash each air cell respectively, and it is possible to exchange some air cells for new air cells. By this, for example at a hospital, washing of the air cells becomes easy, and it is possible to exchange some air cells for new air cells according to the state of the air cells. Thus, it is exceedingly advantageous for keeping the air cells clean always.

The above and other objects, features, and advantages of the present invention will become more apparent from the following description and the accompanying drawings.

DESCRIPTION OF THE PREFERRED EMBODIMENTS

Figure 1:
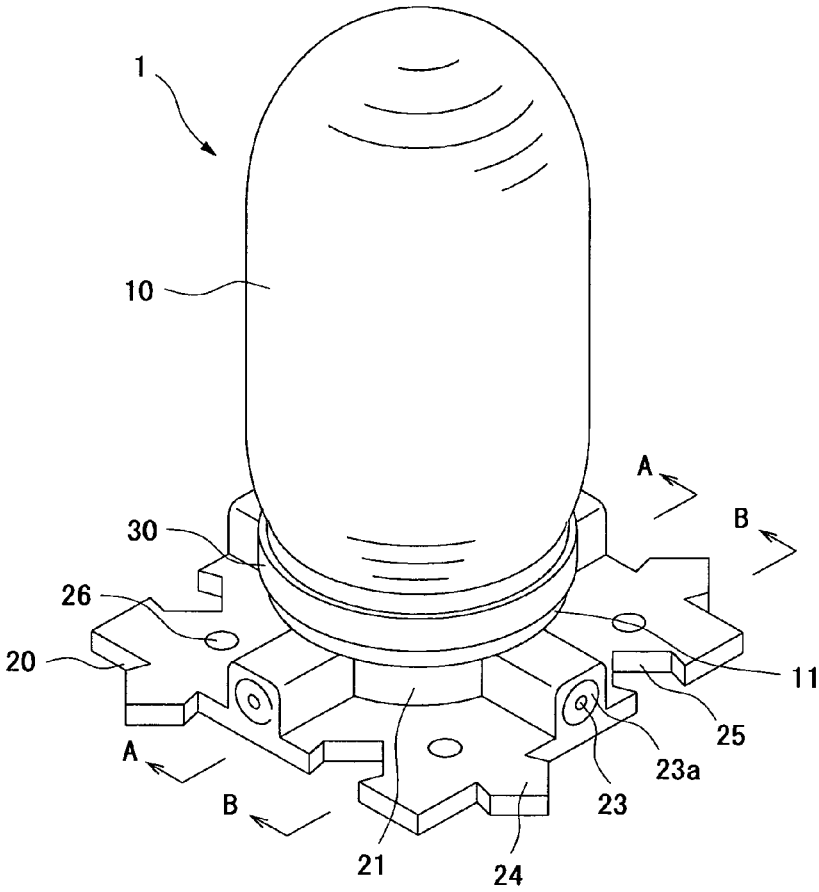
FIG. 1 is a perspective view of a air cell unit showing a first embodiment of the present invention.
Figure 2:
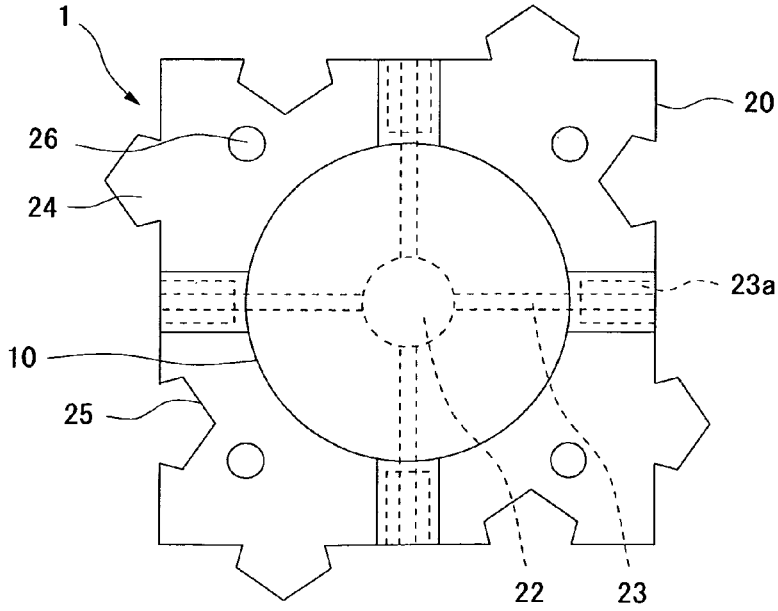
FIG. 2 is a plan view of the air cell unit.
Figure 3:
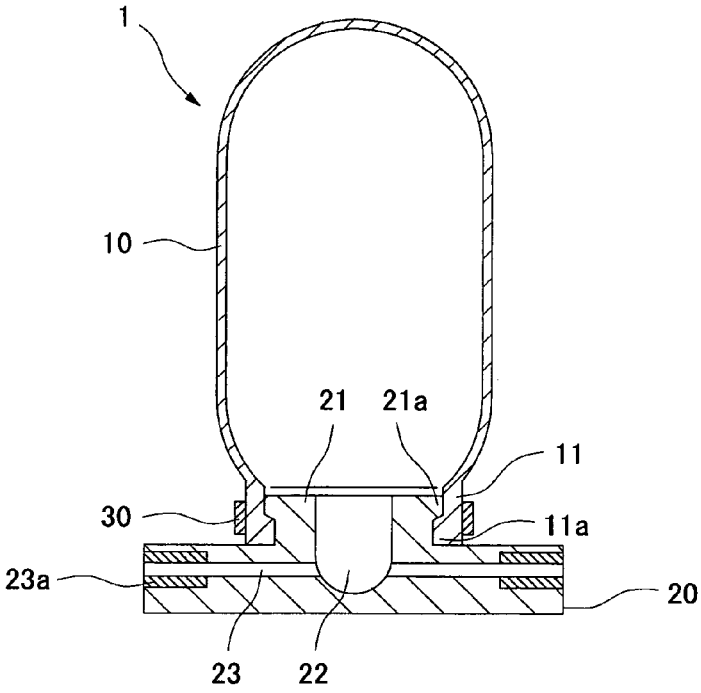
FIG. 3 is a sectional view taken along line A-A in FIG. 1.
Figure 4:
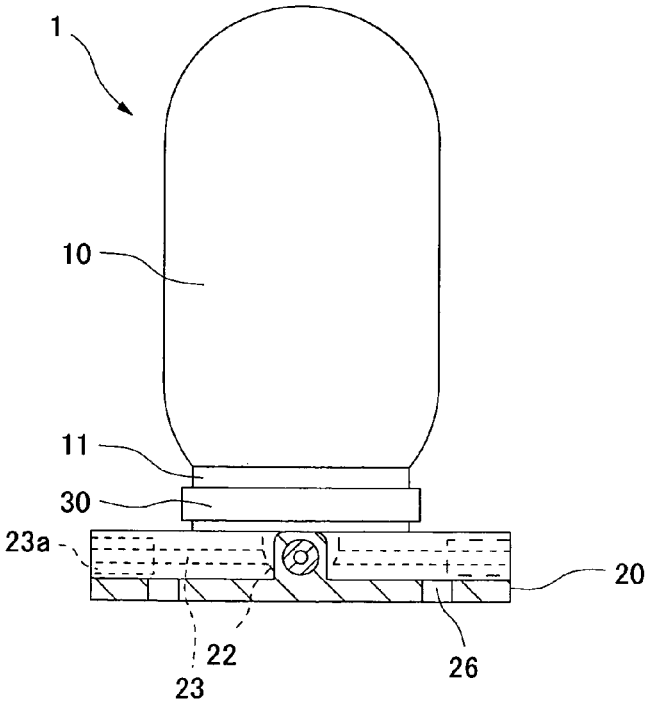
FIG. 4 is a sectional view taken along lime B-B in FIG. 1.
Figure 5:
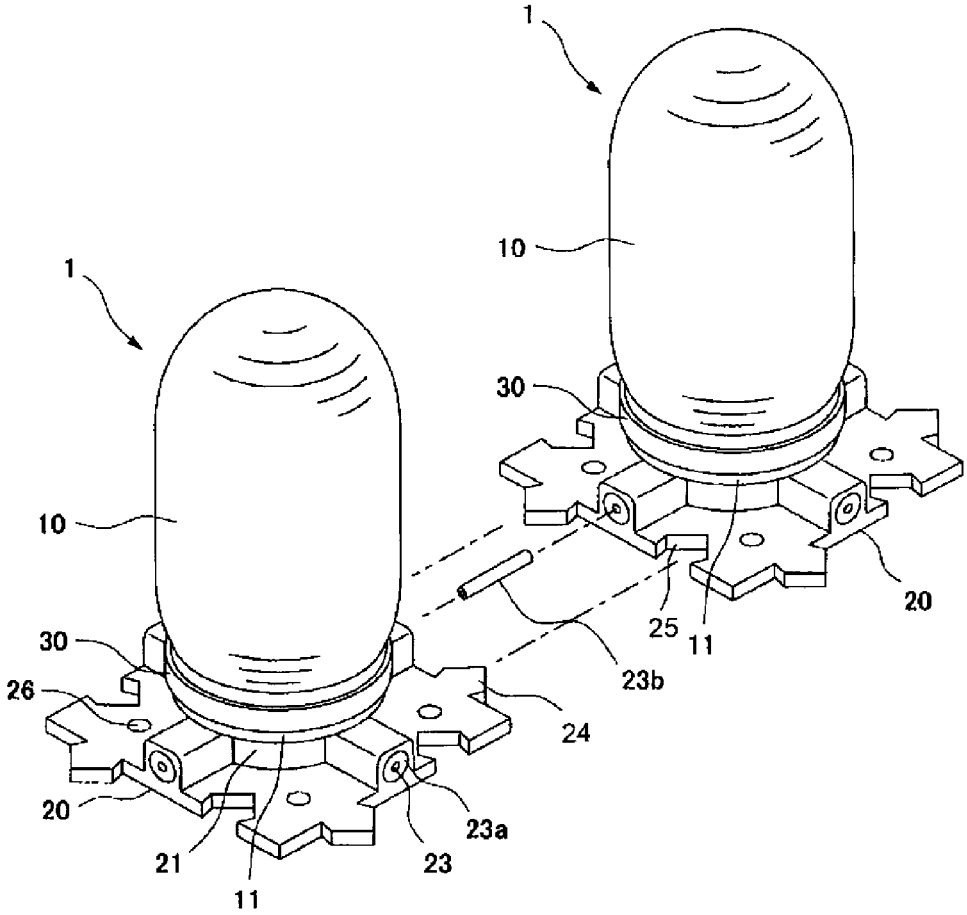
FIG. 5 is a perspective view of two air cell units which have not been connected each other.
Figure 6:
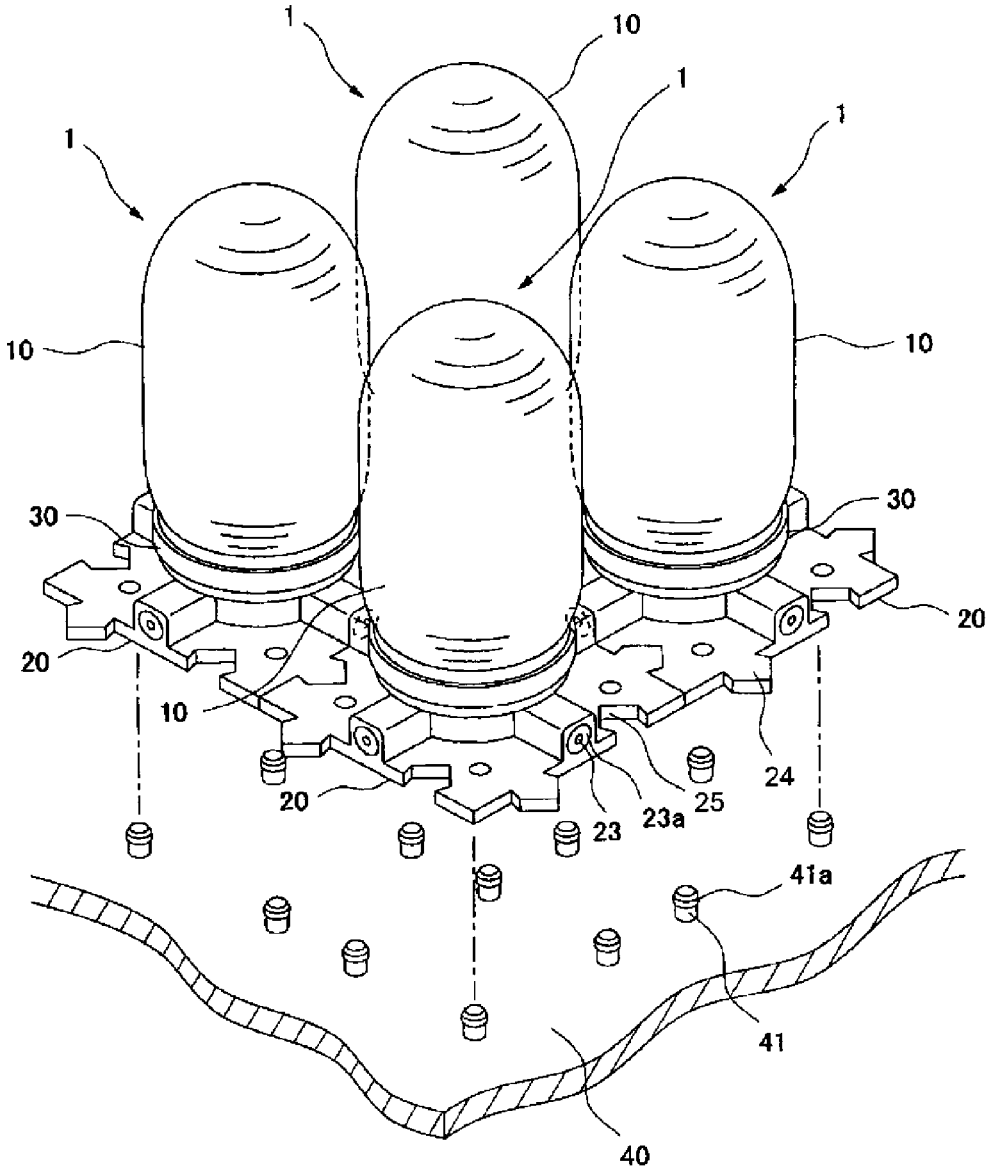
FIG. 6 is a perspective view of the plurality of air cell units connected each other which have not been attached to a installation plate.
Figure 7:
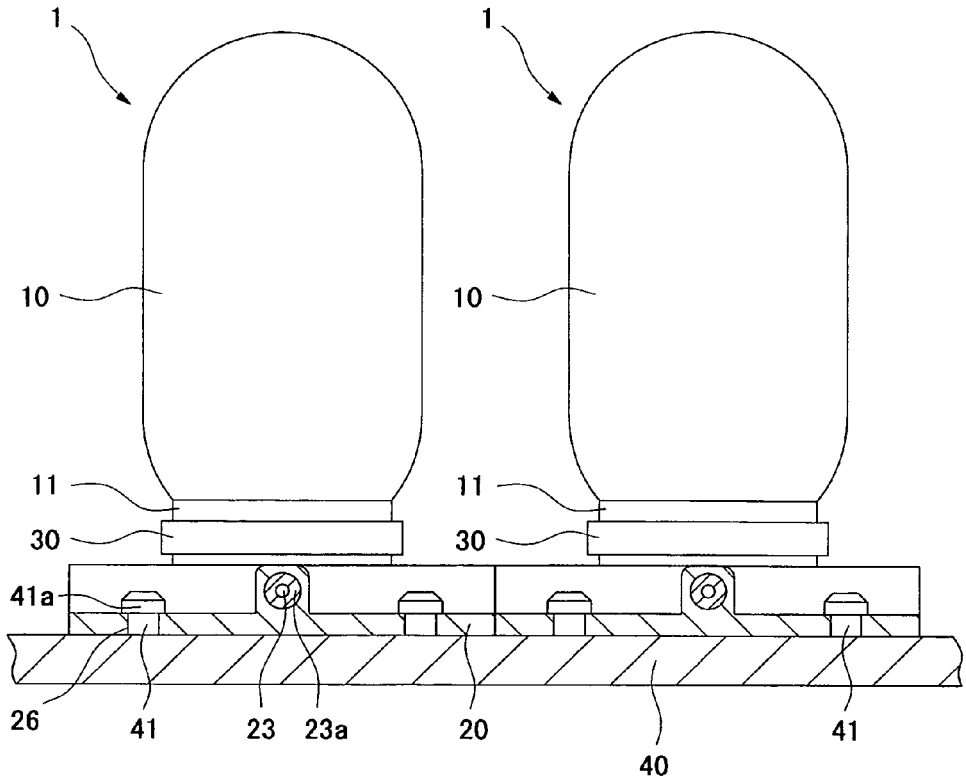
FIG. 7 is a side sectional view of the plurality of air cell units being attached to the installation plate.

FIGS. 1 to 7 show a first embodiment of the present invention. FIG. 1 is a perspective view of a air cell unit, FIG. 2 is a plan view of the air cell unit, FIG. 3 is a sectional view taken along line A-A in FIG. 1, FIG. 4 is a sectional view taken along lime B-B in FIG. 1, FIG. 5 is a perspective view of two air cell units which have not been connected each other, FIG. 6 is a perspective view of the plurality of air cell units connected each other which have not been attached to a installation plate, FIG. 7 is a side sectional view of the plurality of air cell units being attached to the installation plate.

A cushion has a plurality of air cells 10 provided with one opening end portion 11 respectively, a plurality of base members 20 on which the opening end portions 11 of the air cells 10 are being attached respectively, and a plurality of clamp members 30 being attached detachably and respectively to outer surfaces of the air cells 10 being attached to the base members 20. A plurality of air cell units 1 are composed by the air-cells 10, base members 20, and clamp members 20. The cushion also has an installation plate 40 on which the air cell units 1 is attached detachably. The clamp member 30 corresponds to the pressing member indicated in the claims.

The air cell 10 is made from flexible material such as soft rubber material or soft resin material, and the air cell 10 is formed to a bag-like shape and being capable of housing air. The opening end portion 11 is formed so as to be thicker than other portion of the air cell 10. A projection 11*a* is provided on the inner peripheral surface of the opening end portion 11, and is protruding toward inner side in the radial direction of the air cell 10 compared with the inner peripheral surface of the opening end portion 11.

The base member 20 is made from harder material, such as rubber material or resin material, than the material of the air cell 10, and is formed to a rectangular plate-like shape. A protrusion portion 21 is provided on one thickness-direction surface of the base member 20. The protrusion portion 21 is formed so as to protrude from one thickness-direction surface of the base member 20 and is formed so as to have a circular section shape. A concave portion 22 is provided at the center portion of the protrusion portion 21, and the concave portion 22 is formed so as to extend in the thickness-direction of the base member 20. A radial direction projection 21*a* is provided on the tip side of the outer peripheral surface of the protrusion portion 21, and the radial direction projection 21*a* is formed so as to protrude toward outer side of radial direction compared with the outer peripheral surface of the base side of protrusion portion 21. The opening end portion 11 of the air cell 10 is attached to the outer peripheral surface of the protrusion portion 21 by fitting, and the projection 11*a* of the opening end portion 11 connects with radial projection portion 21*a* of the protrusion portion 21 in the detachment direction of the air cell 10.

Four air passages 23 are provided in the base member 20 so as to penetrate the base member from outer peripheral surface of the base member 20 to the concave portion 22, the air passages 23 are arranged at equal angle intervals in the circumferential direction each other. The air passages 23 are opening at four end portion of the rectangular base member respectively. Above mentioned opening portions of the air passages 23 consist of cylindrical member 23*a* respectively.

The cylindrical members 23*a* are made from rubber material or resin material harder than the material of the base member 20.

One projection portion 24 and one recessed portion 25 are provided on every end portion of the base member 20 respectively. The projection portion 24 and the recessed portion 25 are disposed at a certain position of each end portion of the base member 20. Thus, as shown in FIG. 5, when a plurality of base members 20 are disposed so that their end portions come close to each other, the projection portion 24 of one base member 20 of two close base members 20 and the recessed portion 25 of the other base member 20 of two close base members 20 connect to each other, and the projection portion 24 of the other base member 20 and the recessed portion 25 of one base member 20 connect to each other. By this, if the base member 20 and another base member 20 are disposed on a certain flat surface so that their end portions come close to each other, the base member 20 connects with another base member 20. Thus, the air cells 10 which are attached the base members 20 are disposed in a certain flat direction. When the base members 20 are connected to each other, a plurality of connecting pipes 23*b* are disposed between base members 20. Also, the connecting pipes 23*b* are inserted into the cylindrical members 23*a* of the base members 20. By this, when the base members 20 are connected to each other, the air passages 23 of the base members 20 communicate with each other via the connecting pipes 23*b*. Four connecting holes 26 are provided in each base member 20, and the connecting holes 26 are formed so as to penetrate the base member 20 in its thickness-direction.

The clamp member 30 is made of coil spring formed into a ring-like shape. After the air cell 10 is attached to the protrusion portion 21 of the base member 20, the clamp member 30 is attached on an outer peripheral surface of the opening end portion 11 of the air cell 10. The clamp member 30 has a smaller inside diameter than an outer diameter of the opening end portion 11 of the air cell 10 being attached to the protrusion portion 21. If the clamp member 30 is attached to the opening end portion 11, the opening end portion 11 is pressed toward the protrusion portion 21 by clamp member 30. In this embodiment, the clamp member 30 is made of coil spring. However, it is possible to employ a ring-like member made from metal material, rubber material or resin material having higher stiffness than the material of the base member 20. In this case, if the ring-like member is formed so that the inside diameter of the ring-like member is slightly smaller than the outer diameter of the opening end portion 11, the opening and portion 11 is pressed toward the protrusion portion 21.

The installation plate 40 is made from rubber material or resin material harder than the material of the air cell 10, and is formed to a rectangular plate-like shape. The installation plate 40 has the area which is larger from several times to several hundred times than the base member 10. A plurality of connecting portions 41 are provided on the upper surface of the installation plate 40, and the connecting portions 41 are formed so as to protrude from the upper surface of the installation plate 40 in the thickness-direction. The connecting portions 41 are formed so that the outer diameter of its tip portion is larger than the outer diameter of its base portion. The connecting portions 41 are disposed on positions which correspond with the positions of the connecting holes 26 of the connected base members 20. The base members 20 are fixed to the installation plate 40 by inserting the connecting portions 41 into the connecting holes 26. The connecting hole 26 engages with the tip portion 41*a* of the connecting portion 41 being inserted into the connecting hole 26. By this, the resistance force against detachment is generated when the connecting portions 41 are detached from the connecting holes 26. Thus, the base members 20 are detachably attached to the installation plate 40, and are certainly positioned by the installation plate 40. If the connecting portions 41 are capable of inserting into the connecting holes 26, the base member 20 is capable of being positioned at an arbitrary position on the installation plate 40.

The above-mentioned cushion is used, for example, by being laid on the bed of a hospital, and it has the area according to the size of the bed. Moreover, the cushion laid in the bed is covered with a sheet. The air cells 10 are filled up with the air of predetermined quantity by supplying air from the air passage 23 of at least one base member 20. Thereby, while the patient is lying on the bed, the air pressure in each air cell 10 becomes equivalent to each other by air passages 23 which make the insides of air cells 10 communicate. By this, the pressure added to a patient's body can be dispersed, and generating of a bedsore is prevented.

In this case, by setting up the size and the arrangement of the air cells 10 according to the patient's height, body shape, the state or the condition of the affected part, it is possible to disperse more effectively the pressure added on the patient's body. For example, when the air cell 10 arranged in the position with the tendency for big weight to be added by a patient's shoulder, the waist, and the heel differs from the size of the air cell 10 arranged in other positions, it is possible to disperse more effectively the pressure added on the patient's body. Since the air cells 10 are attached detachably to the base members 20, the size of each air cell 10 and arrangement can be set up arbitrarily.

The air cells 10 are made of soft rubber material or soft resin material in order to disperse the pressure added to the patient's body. For this reason, the air cells 10 are easy to damage. About this situation, the air cells 10 are attached detachably to the base members 20. By this, when breakage arises in some air cells 10, it is possible to exchange only the broken air cell 10.

Furthermore, since each air cell 10 supports the patient through the sheet, it is desirable for each air cell 10 to be always clean. About this situation, the air cells 10 are attached detachably to the base members 20. By this, it is possible to take off each air cell 10 and to wash each air cell 10, it is also possible to exchange some air cells 10 to new air cells.

Moreover, each base member 20 is being fixed to the installation plate 40 respectively. Thereby, a positional deviation of each air cells 10 attached to each base member 20 does not arise easily.

Thus, according to the present embodiment, it is possible to arbitrarily set up the size or the arrangement of the air cells 10. By this, for example, in a hospital, it is possible to exchange the size or the arrangement of the air cells 10 on a bed according to the patient's height, the body shape, state or condition of the affected part. Thus, it is exceedingly advantageous for dispersing effectively the pressure added on the body.

Also, it is possible to change the material, hardness, etc. of the air cells 10 according to the state or the condition of the affected part. For this reason, the pressure added to the body can be distributed more effectively.

Furthermore, when breakage arises in some air cells 10, it is possible to exchange only the air cell 10 which is broken. Thus, it is possible to repair the air cells 10 easily and inexpensively.

Moreover, it is possible to take off each air cell 10 and to wash each air cell 10, it is also possible to exchange some air cells 10 for new air cells 10. By this, for example, in a hospital, it is possible to wash easily the air cells 10, and exchange the air cells 10 according to state of the air cells 10. Thus, it is exceedingly advantageous for keeping the air cells 10 always clean.

Also, the protrusion portion 21 is provided on the base member 20, and the opening end portion 11 of the air cell 10 is attached to the protrusion portion 21 by fitting. Thus, it is possible to attach the air cell 10 to the base member 20 easily and certainly.

Also, the opening end portion 11 which is fitting to the protrusion portion 21 is pressed toward the protrusion portion 21 by the clamp member 30. By this, it is possible to avoid the air leak from gap between the air cell 10 and the base member 20, and it is exceedingly advantageous for keeping the constant amount of air in the air cells 10.

Also, the base members 20 are being fixed on the installation plate 40 respectively, and a positional deviation of each air cells 10 attached to each base member 20 does not arise easily. Thus, it is possible to move the patient on the bed easily.

Moreover, a plurality of connecting portion 41 is provided on the installation plate 40, and the connecting hole 26 is provided on the base member 20. Also, by inserting the connecting portions 41 into the connecting hole 26 of each of base member 20, the base members 20 are detachably fixed on the installation plate 40. By this, it is possible to change the arrangement of the base members 20. Thus, when the size or the arrangement of the air cells 10 is changed according to the patient's height, the body shape, or state or condition of the affected part, it is possible to take off the air cells 10 together with base members 20 from installation plate 40. Therefore, it is exceedingly advantageous for changing the size or the arrangement of the air cells 10 easily and quickly.

In the present embodiment, the cushion is used at bed. However, the cushion is capable of being used at a wheelchair or a chair. At this time, the setup of size and arrangement of the air cells 10 are easy, and exchange and washing of air cells 10 are also easy. Therefore, it is possible to acquire the same effect as the above-mentioned.

Also, in the present embodiment, the base members 20 are fixed on the installation plate 40 respectively. However, Because the base members 20 are capable of connecting each other, without the installation plate 40, it is also possible to acquire the same effect as the above-mentioned.

Figure 8:
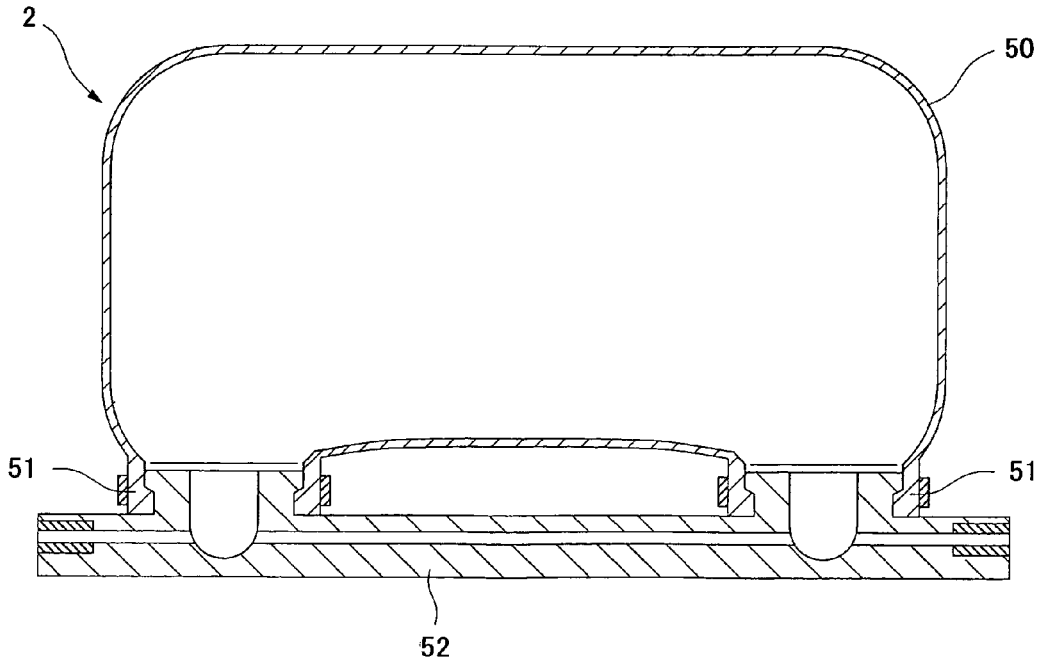
FIG. 8 is a side sectional view of the air cell unit showing a first variation of the first embodiment.
Figure 9:
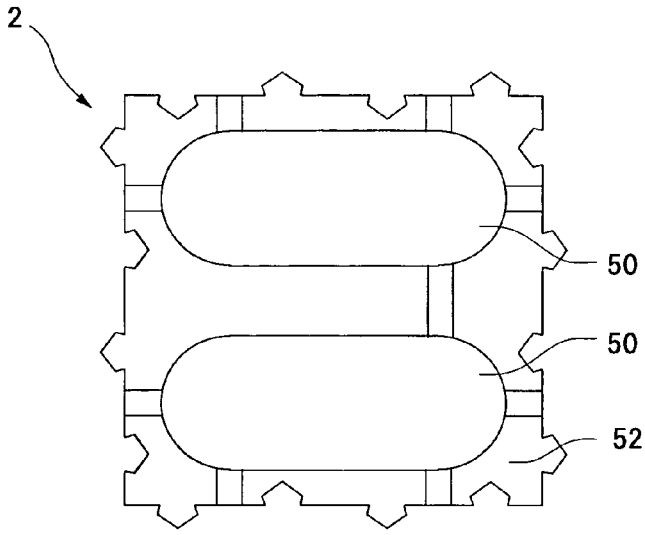
FIG. 9 is a plan view of the air cell unit showing a first variation of the first embodiment.

Also, in the present embodiment, one opening end portion 11 is provided on each air cell 10 respectively, and the air cell units 1 are composed by attaching one air cell 10 to each base portion material 20 respectively. However, like air cell unit 2 being shown in FIG.8 and FIG. 9, it is possible to provide two opening end portions 51 for each air cell 50 respectively, and to attach two air cells 50 to each base member 52 respectively.

Figure 10:
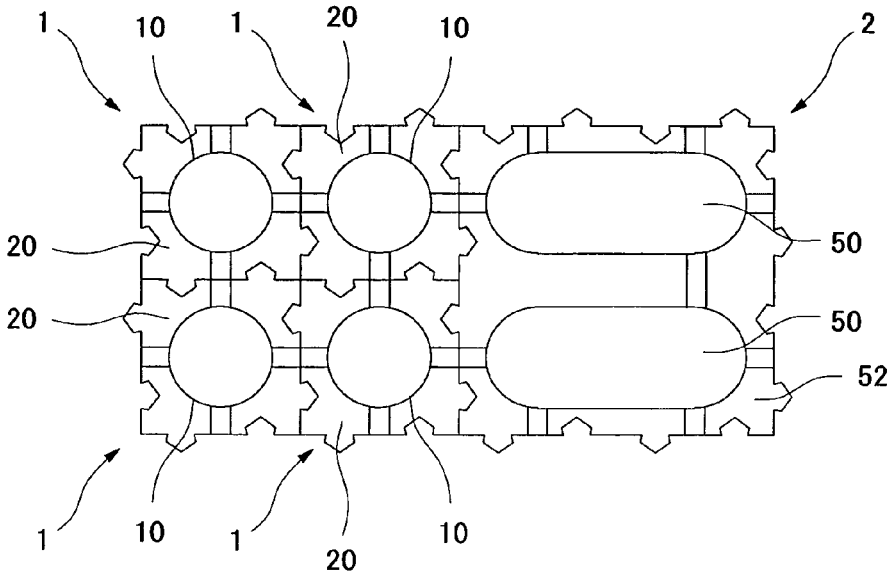
FIG. 10 is a plan view showing an essential part of a cushion showing a first assembled model of the air cell units of the first embodiment.
Figure 11:
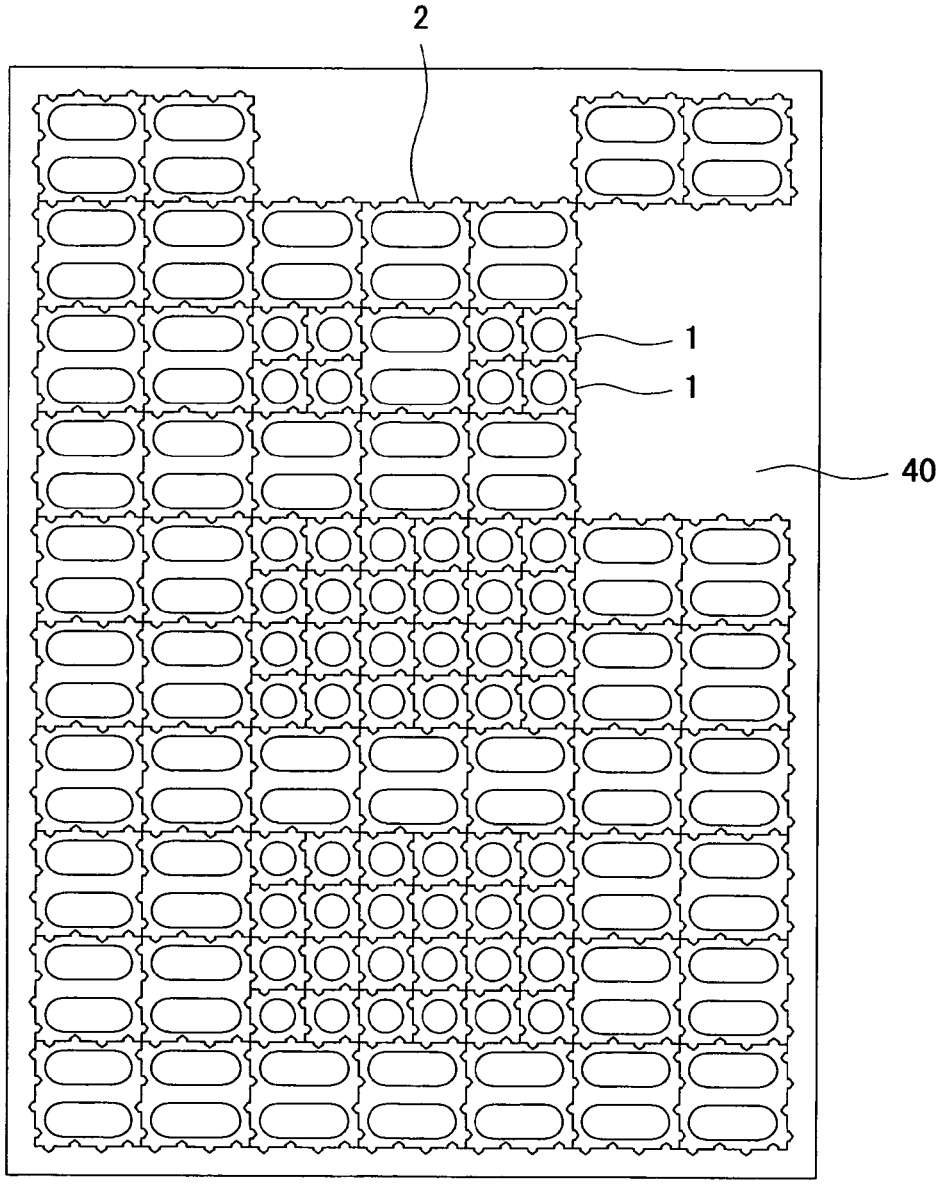
FIG. 11 is a plan view of a cushion showing the first assembled model of the air cell units of the first embodiment.

Also, as shown in FIG.10 and FIG. 11, it is possible that the base member 20 to which is attached one air cell 10 connects to the base member 52 to which is attached two air cells 51. In this case, for example, the base members 20 are disposed on the positions corresponding to the shoulder, the waist, and the heel of the patient to whom weight is added easily. The base members 52 are disposed on other positions. By this, it is possible to effectively disperse the pressure added on the patient's body.

Figure 12:
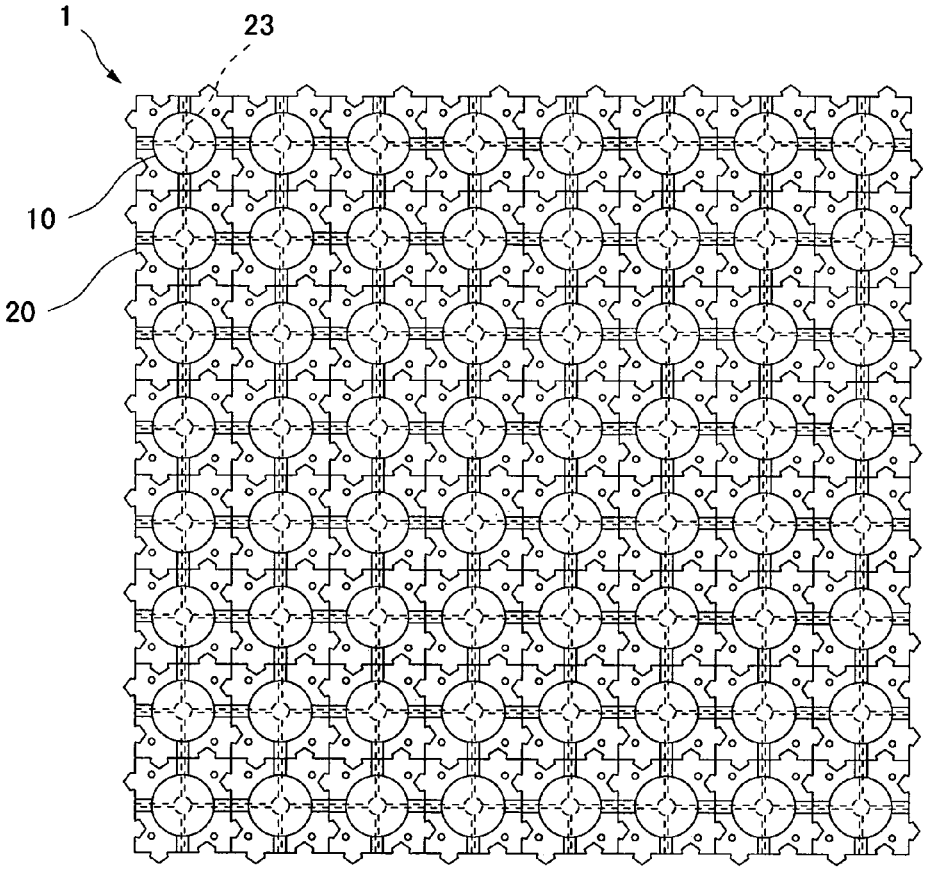
FIG. 12 is a plan view showing an essential part of a cushion showing a second assembled model of the air cell units of the first embodiment.
Figure 13:
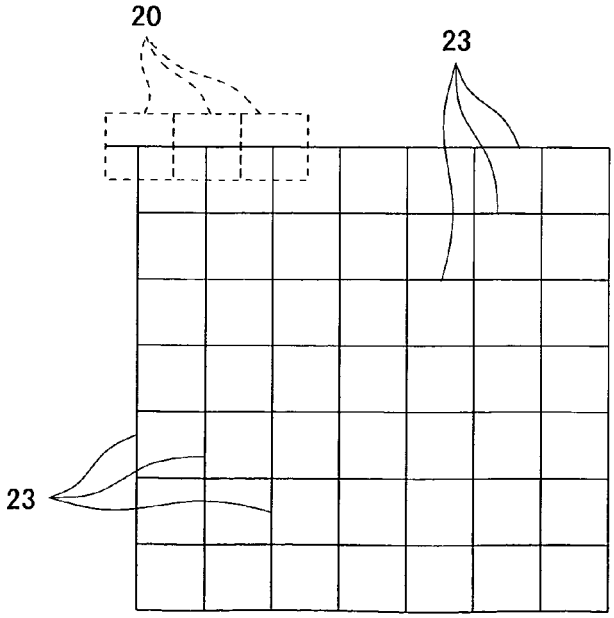
FIG. 13 is a diagram showing a first ventilation passage model of the second assembled model of the air cell units of the first embodiment.
Figure 14:
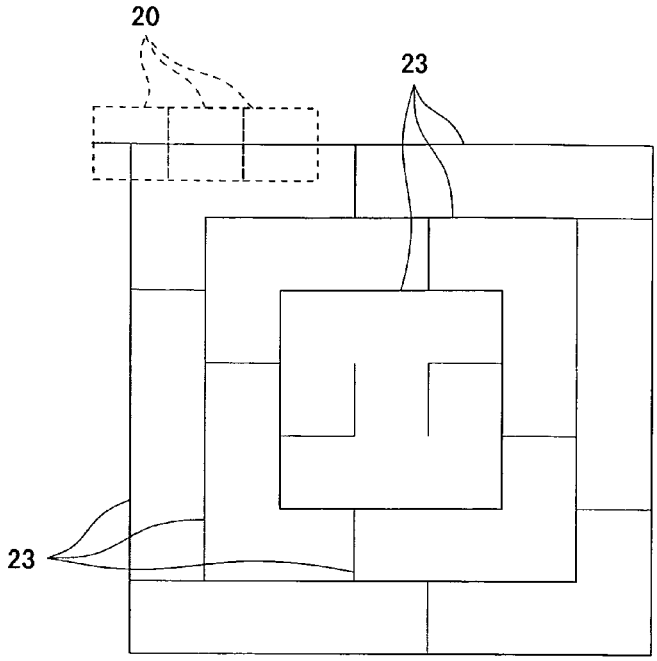
FIG. 14 is a diagram showing a second ventilation passage model of the second assembled model of the air cell units of the first embodiment.

Also, as shown in FIG. 12, by connecting the base members 20, by connecting air passages 23, and by closing the air passage which is not connected with another air passage 23, it is possible to communicate air passages 23 so that the ventilation passageway is formed to the shape shown in FIG. 13. Also, as shown in FIG. 14, it is possible to change the ventilation passageway by closing arbitrary air passages 23. By this, it is possible to adjust the amount of time needed for moving air in air cells 10.

Figure 15:
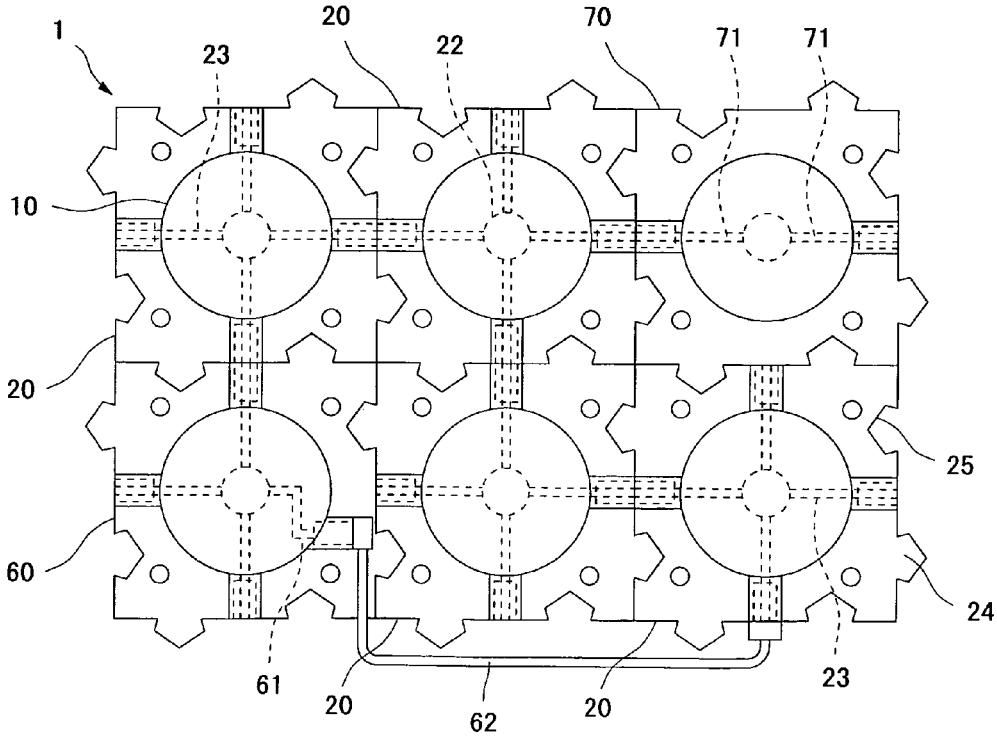
FIG. 15 is a plan view showing an essential part of a cushion showing a third assembled model of the air cell units of the first embodiment.

Also, as shown in FIG. 15, it is possible to provide a base member 60 having air passage 61 which is not connected with the air passage 23 of the base member 20 adjoining to the base member 60. And, by a connecting pipe 62, it is possible to communicate air passage 61 of the base member 60 and air passage 23 of the base member 20 which is not adjoining to the base member 60. Also, it is possible to provide only two air passages 71 on the base member 70. Thus, By the combination of the base members 20, 60, 70, it is possible to change the ventilation passageway being formed by air passages 23, 61, 71.

Figure 16:
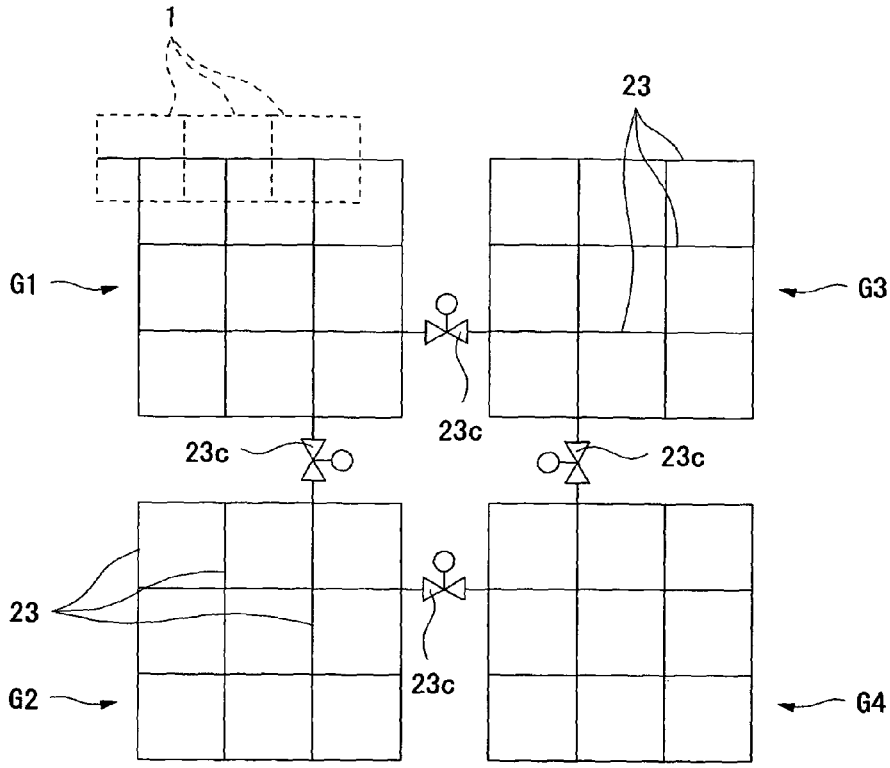
FIG. 16 is a diagram showing a ventilation passage model of the fourth assembled model of the air cell units of the first embodiment.
Figure 17:
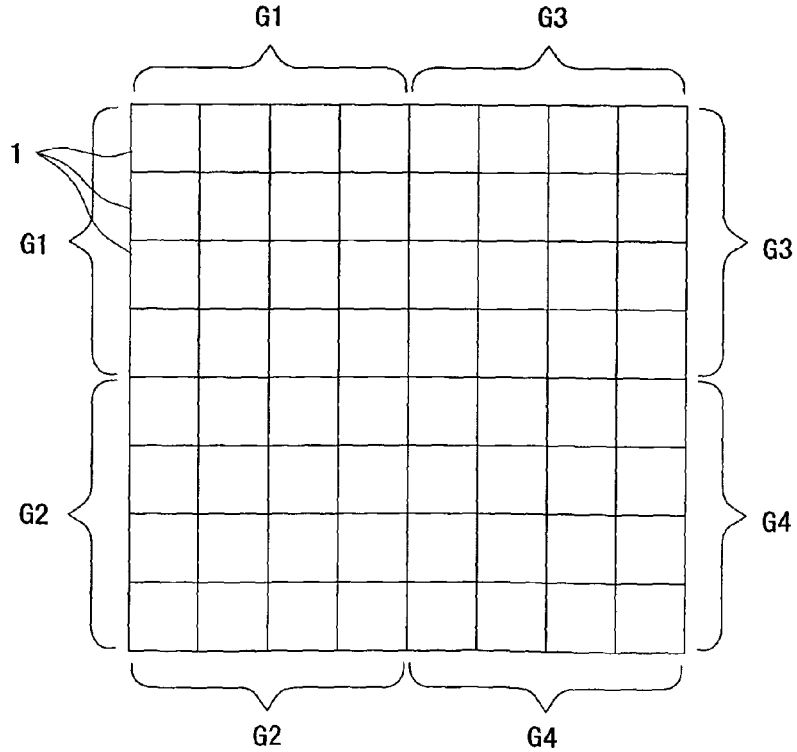
FIG. 17 is a plan view of the cushion showing the fourth assembled model of the air cell units of the first embodiment.

Moreover, it is possible to arbitrarily change the ventilation passageway being formed by the air passages 23. To put it concretely, as shown in FIG. 16 and FIG. 17, the air cell units 1 are divided into first to fourth groups G1, G2, G3, G4 by ventilation passageway being formed by air passages 23. Also, opening-and-closing valves 23*c* is provided to the air passages 23 connecting first to fourth groups G1, G2, G3, G4 each other. By the opening-and-closing valve 23*c*, it is possible to change the ventilation passageway being formed by the air passages 23. Thus, by opening all opening-and-closing valves 23*c*, air pressure in all the air cell units 1 can be made equivalent. Also, by closing all opening-and-closing valves 23*c*, air pressure in air cell units 1 is made equivalent in each group, and it is possible to make difference in air pressure between groups G1, G2, G3, G4.

That case where such a cushion is used for a wheelchair is explained below. First of all, at the time someone sit down on it, the opening-and-closing valves 23*c* are being opened, and air pressure in the air cells is made equivalent. By this, it is possible to effectively disperse the pressure added on the body. Next, by closing the opening-and-closing valves 23*c*, air ventilation between groups is blocked. By this, it is prevented that the air in each air cell 10 moves too much, and it is possible to improve the stability on the cushion.

Figure 18:
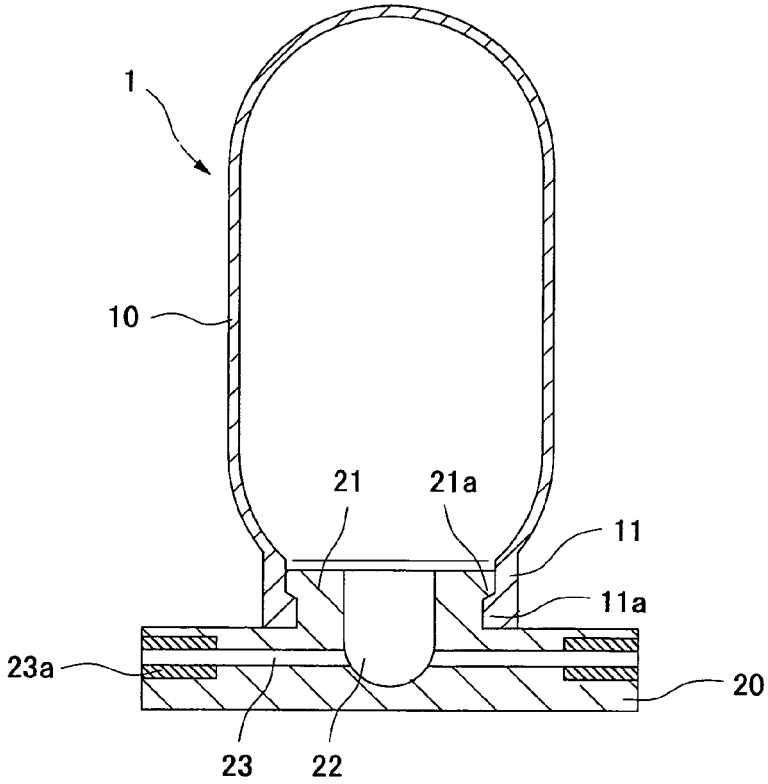
FIG. 18 is a sectional view of the air cell unit showing a second variation of the first embodiment.

In the present embodiment, by the clamp member 30, the opening end portion 11 of the air cell 10 is pressed toward the protrusion portion 21 and being fixed on the protrusion portion 21. However, as shown in FIG. 18, it is possible to fix the opening end portion 11 of the air cell 10 to the protrusion portion 21 by an adhesive. In this case, the clamp member 30 is unnecessary. Also, it is impossible to exchange only the air cell 10. But, it is possible to take off the air cell unit 1 which is composed of the air cell 10 and base member 20. Since the base member 20 is detachably fixed on the installation plate 40, it is possible to easily carry out the setting up of the size and the arrangement of the air cells 10, exchange of the air cells 10, and the washing of the air cells 10.

Figure 19:
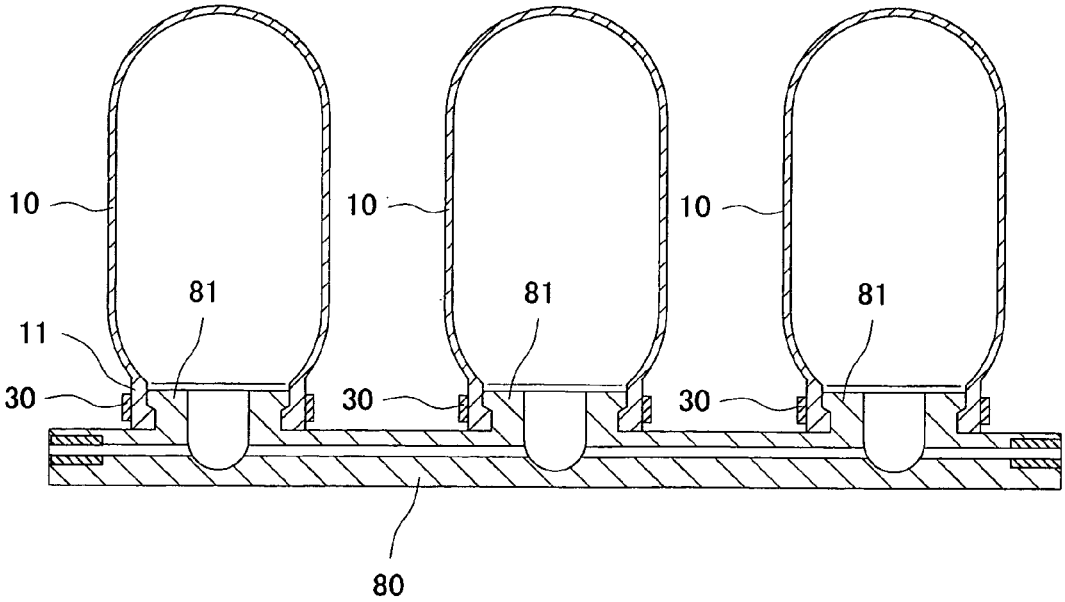
FIG. 19 is a sectional view of a base member showing a fourth variation of the first embodiment.

In the present embodiment, one air cell 10 is attached on each base member 20 respectively. However, as shown in FIG. 19, it is possible to provide a plurality of protrusion portion 81 to a base member 80, and attach two or more air cells 10 on the base member 80.

Figure 20:
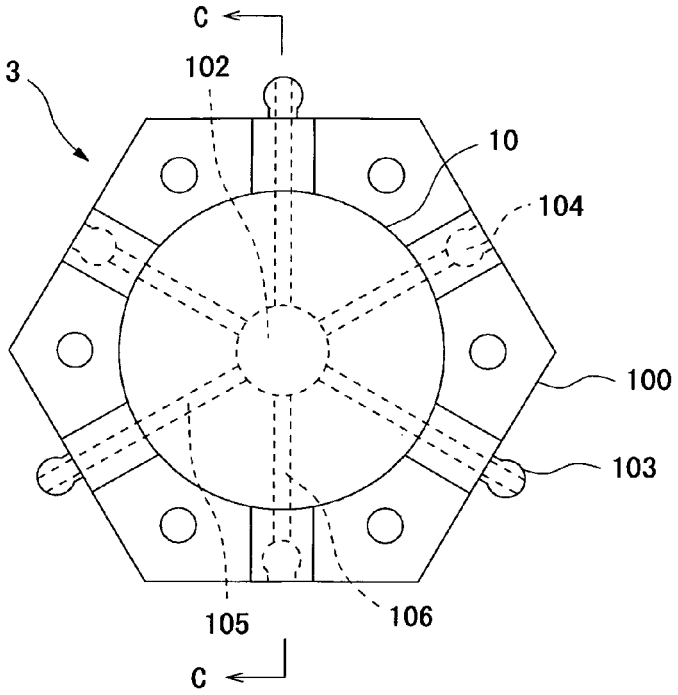
FIG. 20 is a plan view of a air cell unit showing a second embodiment of the present invention.
Figure 21:
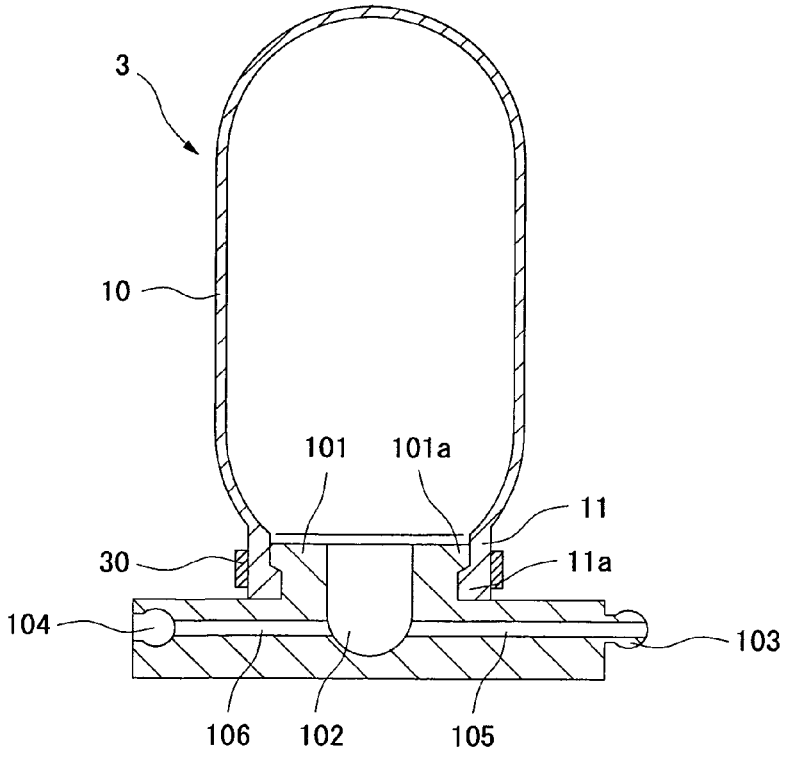
FIG. 21 is a sectional view taken along C-C line in FIG. 20.
Figure 22:
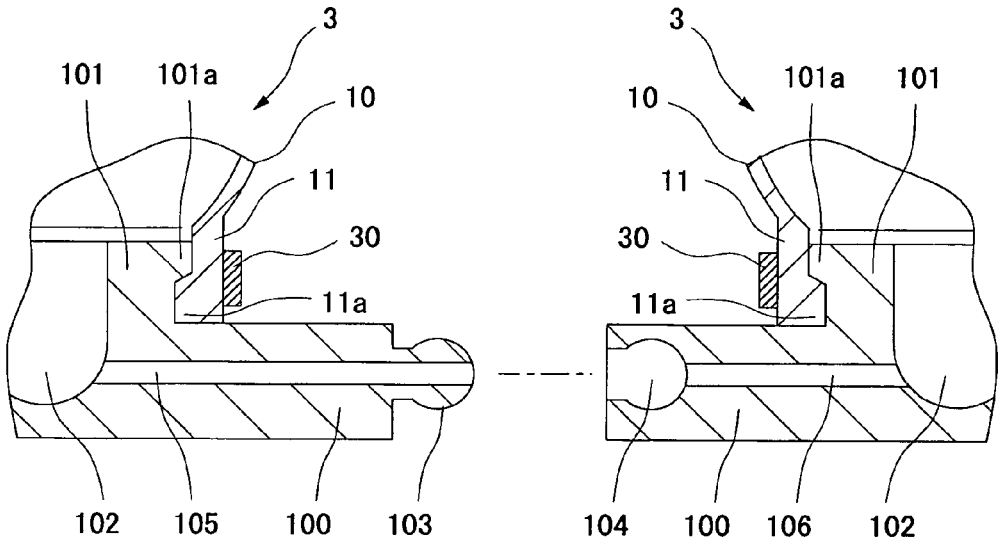
FIG. 22 is a sectional view showing an essential part of a projection portion and recessed portion.
Figure 23:
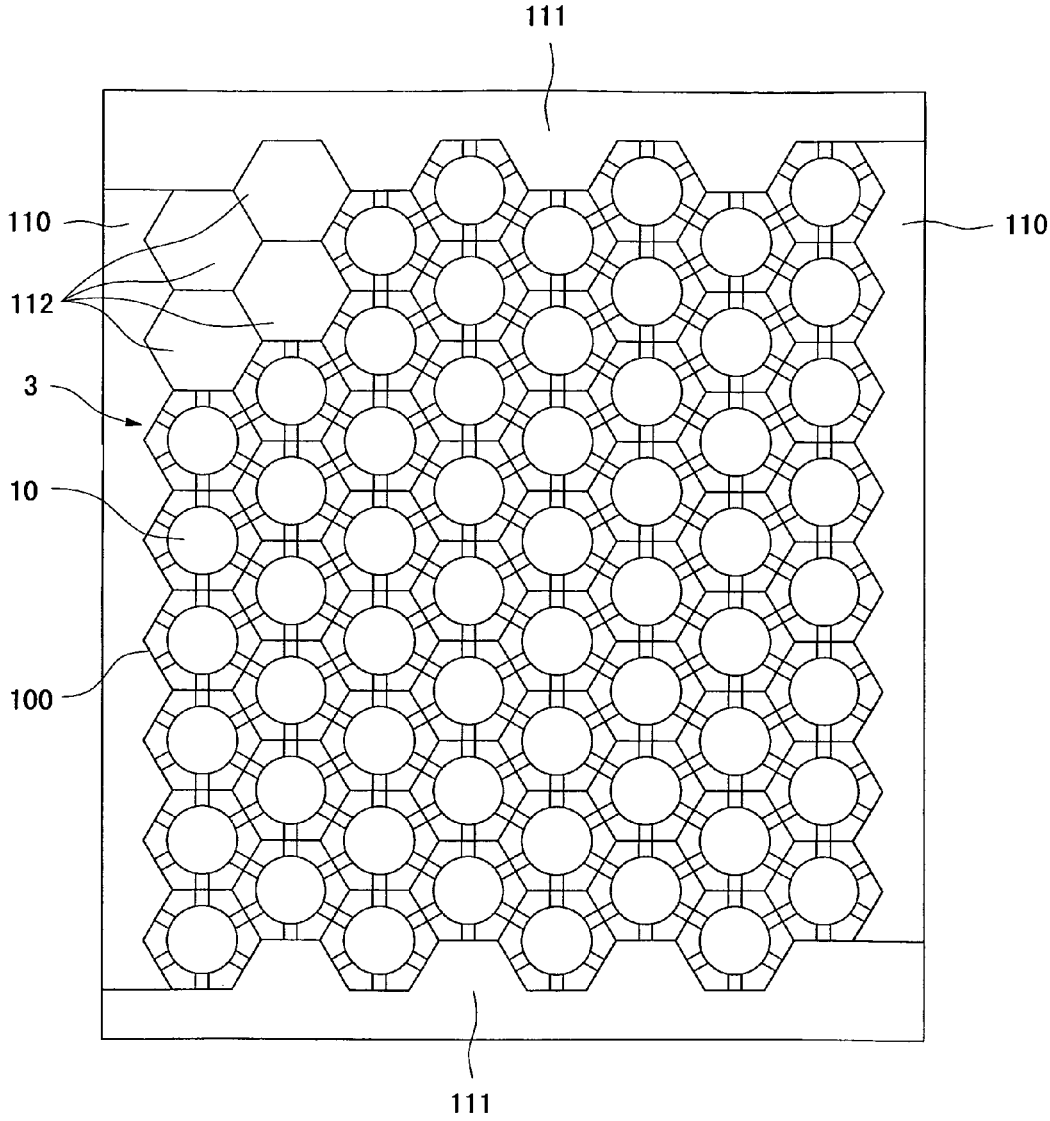
FIG. 23 is a plan view of a cushion.

FIG. 20 to 23 show a second embodiment of the present invention. FIG. 20 is a plan view of a air cell unit, FIG. 21 is a sectional view taken along C-C line in FIG. 20, FIG. 22 is a sectional view showing an essential part of a projection portion and recessed portion, FIG. 23 is a plan view of a cushion. And, it is employed in this embodiment that the same symbols which are being employed to the same or similar structures in the first embodiment.

A cushion has a plurality of air cells 10 and a plurality of clamp members 30 which are same or similar with the first embodiment, a plurality of base members 100 on which the air cells 10 are being attached respectively. And a plurality of air cell units 3 are composed of the air cells 10, the base members 100, and the clamp members 30. Also, the cushion has a pair of first outer frame members 110 and a pair of second outer frame members 111 for covering the outer peripheral portion of the base members 110 being connected, and a dummy member 112.

The base member 100 is made from rubber material or resin material harder than the material of the air cell 10, and formed to a hexagon plate-like shape. A protrusion portion 101 is provided on one thickness-direction surface of the base member 100. The protrusion portion is formed so as to protrude from one thickness-direction surface of the base member 100 and is formed so as to have a circular section shape. A concave portion 102 is provided at the center portion of the protrusion portion 101, and the concave portion 102 is formed so as to extend in the thickness-direction of the base member 100. A radial direction projection 101*a* is provided on the tip side of the outer peripheral surface of the protrusion portion 101, and the radial direction projection is formed so as to protrude toward outer side of radial direction compared with the outer peripheral surface of the base side of the protrusion portion 101. The opening end portion 11 of the air cell 10 is attached to the outer peripheral surface of the protrusion portion 101 by fitting, and the projection 11*a* of the opening end portion 11 connects with radial direction projection 101*a* of the protrusion portion 101 in the detachment direction of the air cell 10.

Three projection portions 103 are provided on the outer peripheral surface of the base member 100 and the projection portions 103 are arranged at equal angle intervals in the circumferential direction each other. And three recessed portions 104 are provided on the outer peripheral surface of the base member 100 and the recessed portions 104 are arranged at equal angle intervals in the circumferential direction each other. The recessed portions 104 and the projection portions 103 are alternately disposed in the circumferential direction. The projection portions 103 and the recessed portions 104 are provided on every end portion of the hexagon shaped base member 100 respectively. The outer diameter of the tip portion of the projection portion 103 is larger than the outer diameter of the base side of the projection portion 103, and the port of the recessed portion 104 is narrower than its inside.

Three air passages 105 are formed in the base member 100 so as to penetrate from the tip portion of each projection portion 103 to the concave portion 102. Also, three air passages 106 are formed in the base member 100 so as to penetrate from each recessed portion 104 to the concave portion 102.

Thus, by disposing the base members 100 so as to be adjoined to each other, and fitting projection portions 103 and recessed portions 104 to each other, the base members 100 are connected to each other. By this, the air passages 105 communicate with the air passages 106.

As shown in FIG. 23, the outer frame members 110, 111 are formed so as to fit the outer surface of the connected base members 100. Also, since the outer frame members 110, 111 are connected to each other, the movement of each base member 100 is restricted.

The dummy member 112 is formed to the same shape with the base member 100 which has a hexagon plate-like shape. The dummy member 112 is disposed at the position which the base member 100 is not being disposed.

Thus, according to the second embodiment, the air cells 10 are detachably attached on the base members 100. Thus, the setup of size and arrangement of the air cells 10 are easy, and exchange and washing of air cells 10 are also easy. Therefore it is possible to achieve the same effect of the first embodiment.

Also, by connecting the base members 100 to each other, the air passages 105, 106 are connected to each other. Thus, the setup of size and arrangement of the air cell units 3 becomes easier, and exchange and washing of air cell units 3 becomes easier.

Also, the dummy member 112 is disposed at the position which the base member 100 is not being disposed. By this, it is not necessary to dispose the air cell 10 unnecessarily. Thus, it is possible to effectively dispose the air cells 10, and prevent the unnecessary breakage of the air cell 10.

Figure 24:
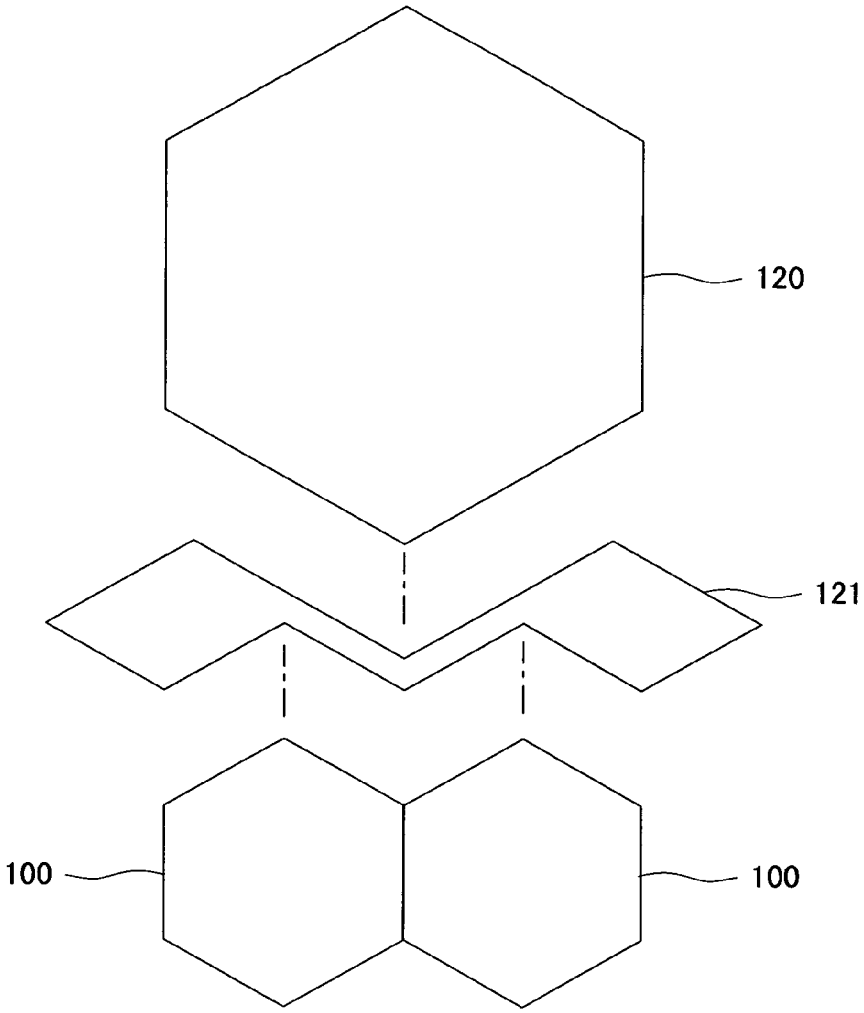
FIG. 24 is a plan view showing an essential part of the cushion showing a assembled model of the air cell units of the second embodiment.

In the second embodiment, two or more base members 100 which have the same size are connected to each other. However, as shown in FIG. 24, it is possible to connect the base member 100 to a base member 120 which has larger size than the base member 100. In this case, by providing a spacer between the base member 100 and the base member 120, it is possible to connect without any gap the base member 100 and the base member 120.

Figure 25:
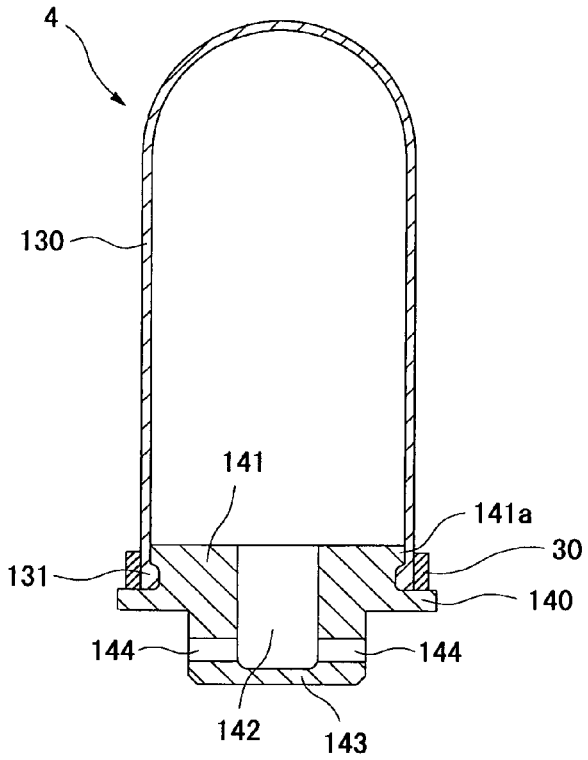
FIG. 25 is a sectional view of a air cell unit of a third embodiment of the present invention.
Figure 26:
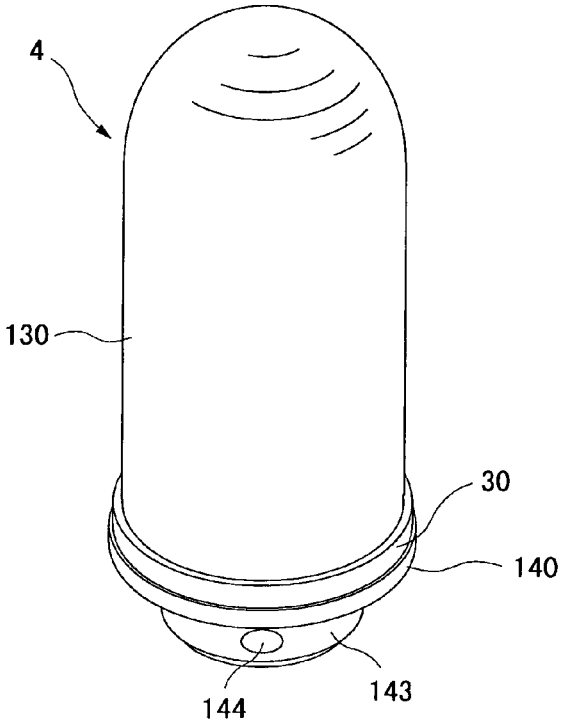
FIG. 26 is a perspective view of a air cell unit.
Figure 27:
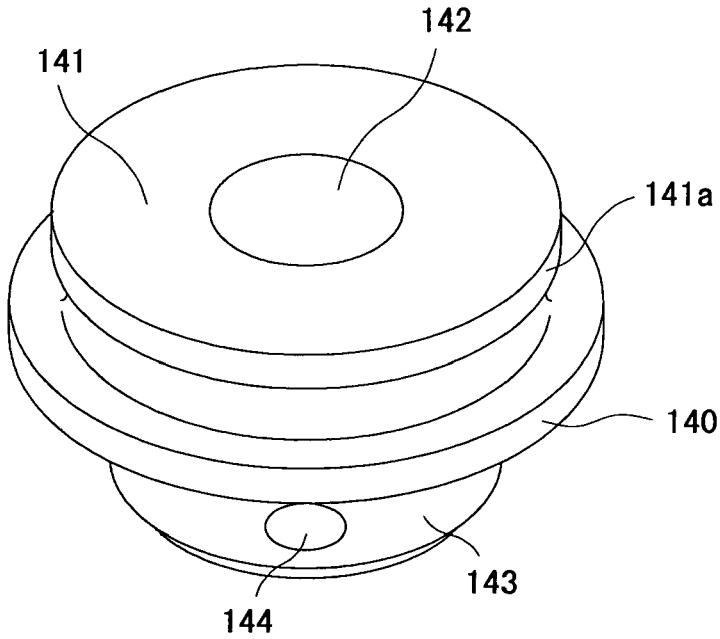
FIG. 27 is a perspective view of a base member.
Figure 28:
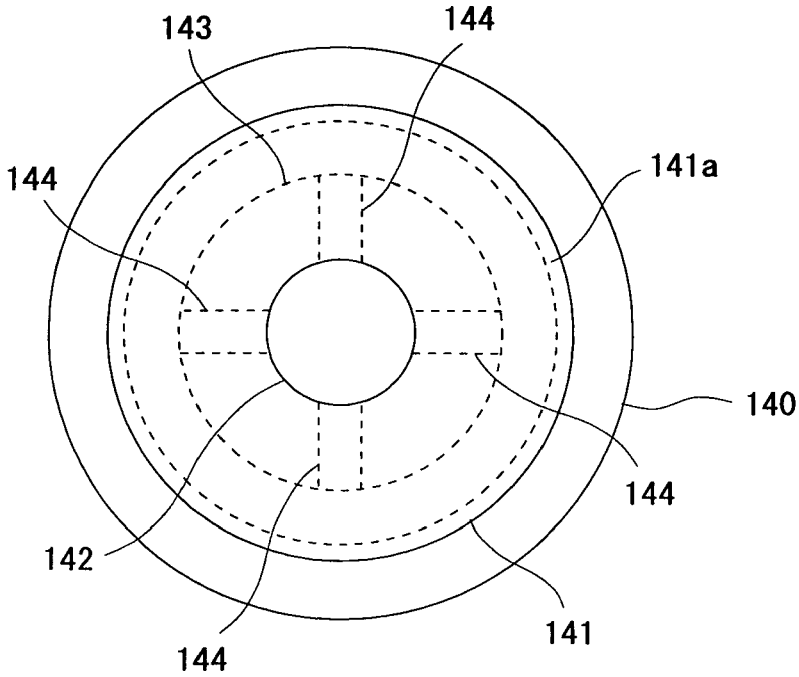
FIG. 28 is a plan view of the base member.
Figure 29:
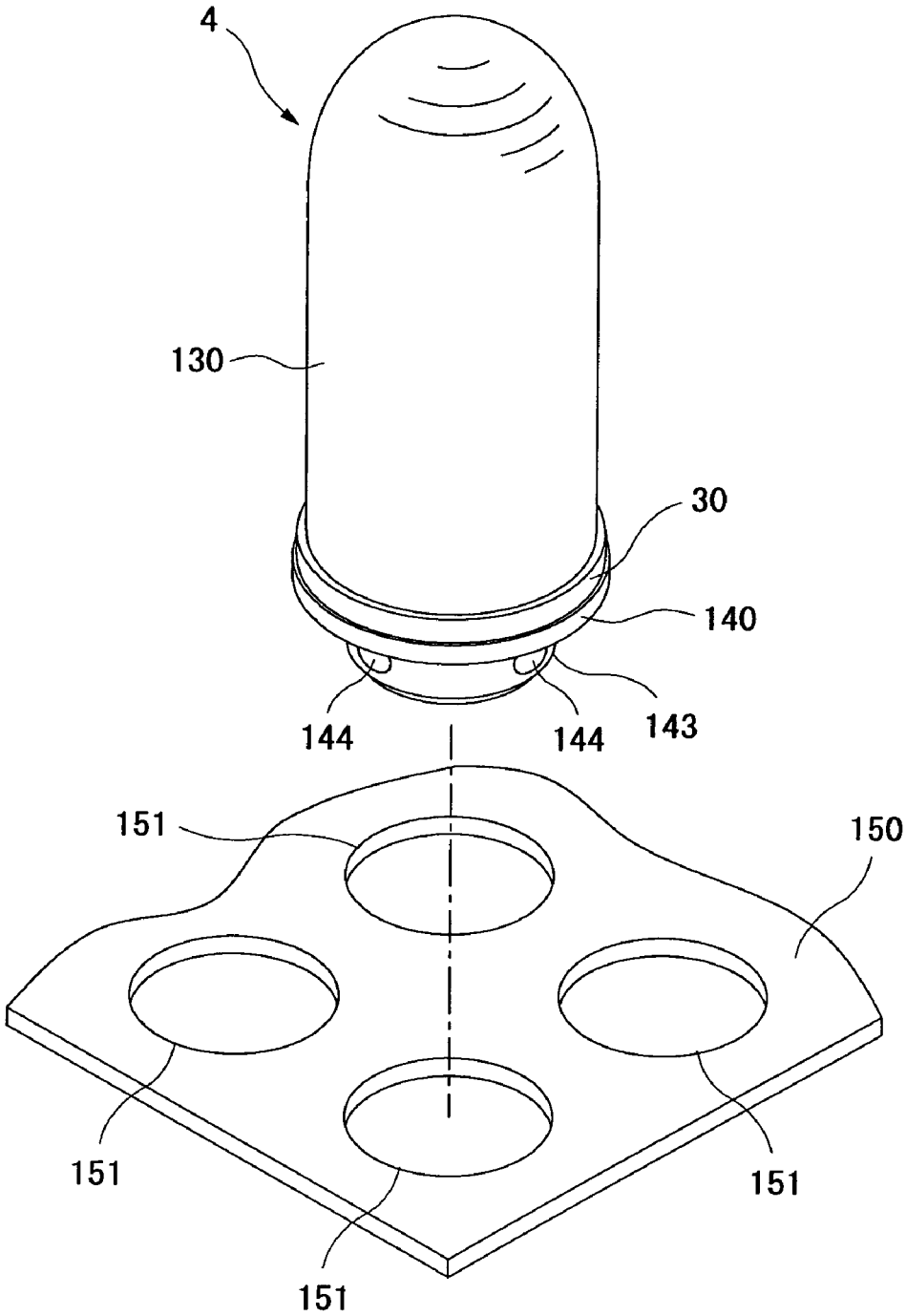
FIG. 29 is a perspective view of a cushion at the time when the air cell unit is being attached to an installation plate.
Figure 30:
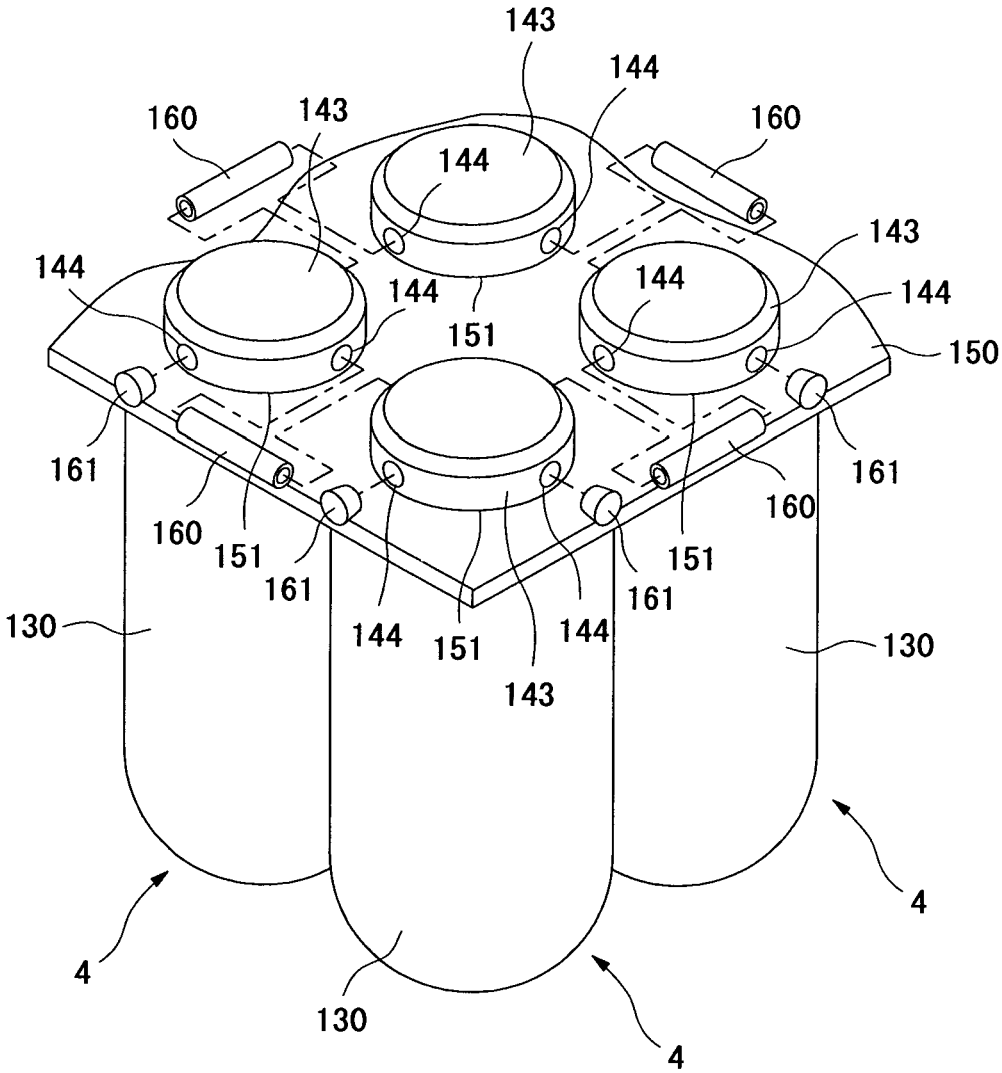
FIG. 30 is a perspective view of the cushion at the time when a connecting pipe and a rubber stopper are being attached to air passages.
Figure 31:
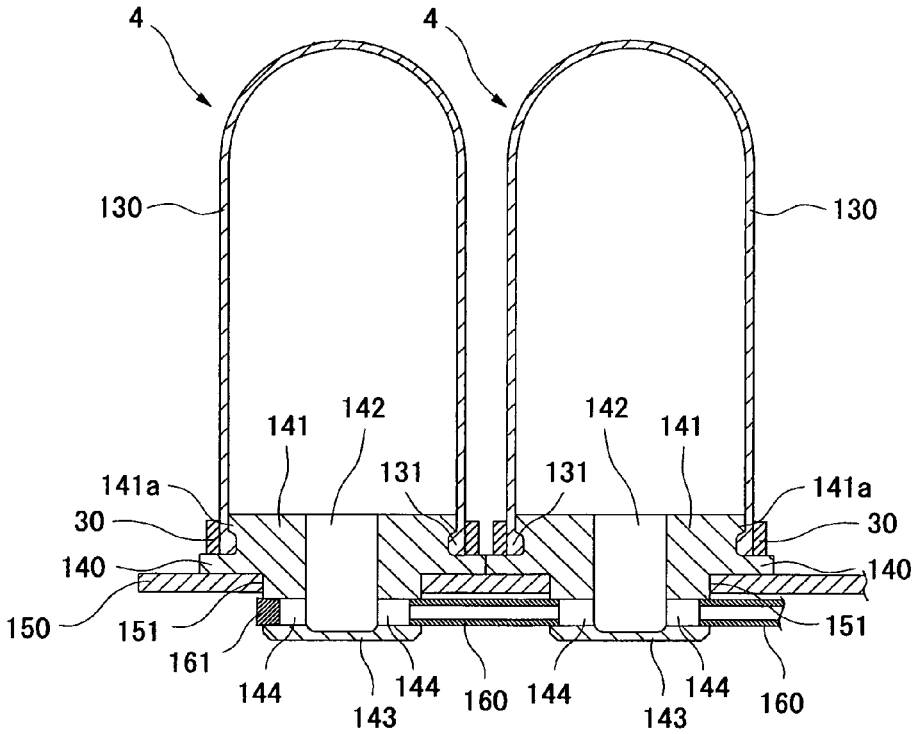
FIG. 31 is a sectional view of the cushion.
Figure 32:
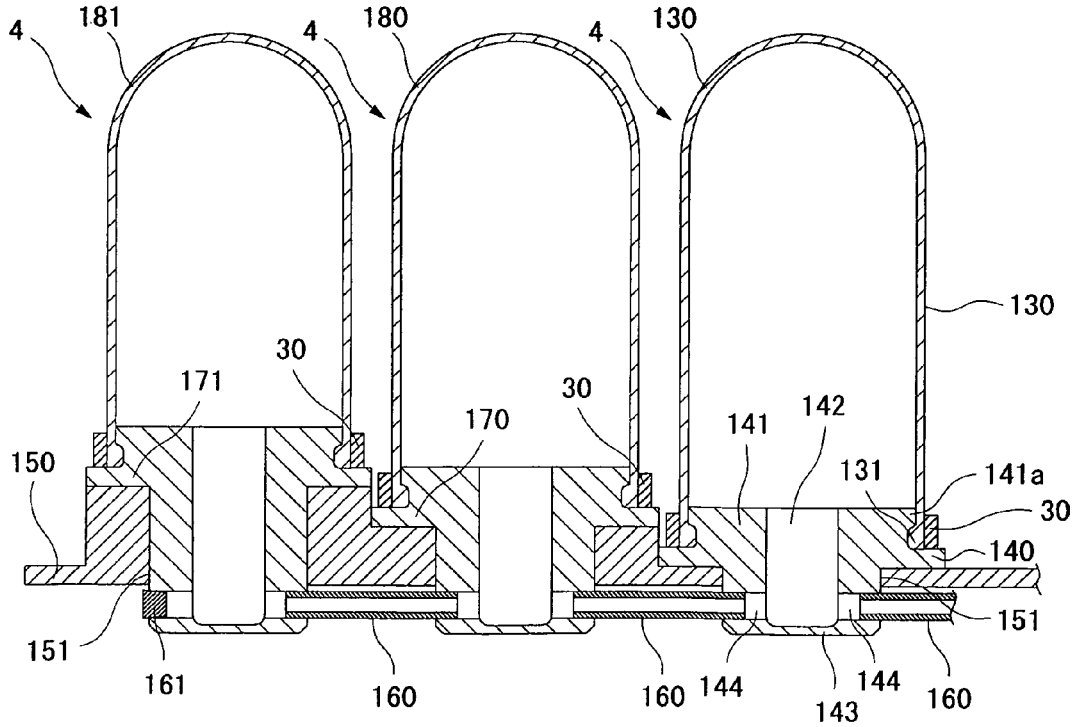
FIG. 32 is a sectional view of a cushion showing a variation of the third embodiment.

FIG. 25 to 31 show a third embodiment of the present invention. FIG. 25 is a sectional view of a air cell unit, FIG. 26 is a perspective view of a air cell unit, FIG. 27 is a perspective view of a base member, FIG. 28 is a plan view of the base member, FIG. 29 is a perspective view of a cushion at the time when the air cell unit is being attached to an installation plate, FIG. 30 is a perspective view of the cushion at the time when a connecting pipe and a rubber stopper are being attached to air passages, FIG. 31 is a sectional view of the cushion. And, it is employed in this embodiment that the same symbols which are being employed to the same or similar structures in the first embodiment.

A cushion has a plurality of clamp members 30 which are same or similar with the first embodiment, a plurality of air cells 130 having one opening portion respectively, and a plurality of base members 140 on which the air cells 130 are being attached respectively. And a plurality of air cell units 4 are composed of the air cells 130, the base members 140, and the clamp members 30. Also, the cushion has a installation plate 150 on which the base members 140 of the air cell units 4 are being detachably attached.

The air cell 130 is made from flexible material such as soft rubber material or soft resin material, and the air cell 130 is formed to a bag-like shape and being capable of housing air. The opening end portion 131 is formed so as to be thicker than other portion of the air cell 130. Also, the inner peripheral surface of the opening end portion 131 is protruding inner side compared with the other portion of the inner peripheral surface of the air cell 130.

The base member 140 is made from harder material, such as rubber material or resin material, than the material of the air cell 130, and is formed to a circular plate-like shape. A first protrusion portion 141 is provided on one thickness-direction surface of the base member 140. The first protrusion portion is formed so as to protrude from one thickness-direction surface of the base member 140 and is formed so as to have a circular section shape. A concave portion 142 is provided at the center portion of the first protrusion portion 141, and the concave portion 142 is formed so as to extend in the thickness-direction of the base member 140. A radial direction projection 141*a* is provided on the tip side of the outer peripheral surface of the protrusion portion 141, and the radial direction projection 141*a* is formed so as to protrude toward outer side of radial direction compared with the outer peripheral surface of the base side of the first protrusion portion 141. The opening end portion 131 of the air cell 130 is attached to the outer peripheral surface of the first protrusion portion 141 by fitting, and the inner peripheral surface of the opening end portion 131 connects with radial projection portion 141*a* of the first protrusion portion 141 in the detachment direction of the air cell 130. After the air cell 130 is attached to the first protrusion portion 141 of the base member 140, the clamp member 30 is attached on outer peripheral surface of the opening end portion 131 of the air cell 130. By this, the opening end portion 131 is pressed toward the first protrusion portion 141 by clamp member 30.

A second protrusion portion 143 is provided on the other thickness-direction surface of the base member 140. The second protrusion portion is formed so as to protrude from the other thickness-direction surface of the base member 140 and is formed so as to have a circular section shape. Four air passages 144 are provided in the second protrusion portion 143 so as to penetrate the second protrusion portion 143 from outer peripheral surface of the second protrusion portion 143 to the concave portion 142. Also, the air passages 144 are arranged at equal angle intervals in the circumferential direction each other.

The installation plate 150 is made from rubber material or resin material harder than the material of the air cell 130, and is formed to a rectangular plate-like shape. The installation plate 150 has the area which is larger from several times to several hundred times than the base member 140. A plurality of through-holes are provided on the installation plate 150 so as to penetrate the installation plate 150 in thickness-direction. The inside diameter of the through-hole 151 is slightly smaller than the outer diameter of the second protrusion portion of the base member 140. If the second protrusion portions 143 are respectively inserted into each through-hole 151 from one thickness-direction surface side to the other thickness-direction surface side of the installation plate 150, the second protrusion portions 143 of the base members 140 are fitted to each through-hole 151. By this, the base members 140 are detachably attached to the installation plate 150. Also, the other thickness-direction surface of the base member meets the one thickness-direction surface of the installation plate 150. By this, the base members 140 are disposed so as to be arranged on a certain flat surface. When the base members 140 are attached to the installation plate 150, the second protrusion portion 143 of the base member 140 sticks out from the other thickness-direction surface of the installation plate 150. Also, the air passages 144 provided in the second protrusion portion 143 are disposed at the other thickness-direction surface side of the installation plate 150. In this case, a plurality of connecting pipes 160 are disposed between the base members 140, and the connecting pipe 160 are inserted into the air passages 144 respectively. By this, the air passages 144 of the base members 140 communicate each other via the connecting pipes 160. The connecting pipe 160 corresponds to the connecting member written in the claims. The air passage 144 into which the connecting pipe 40 is not inserted is closed by the rubber stopper 161. In the present embodiment, the air passage 144 into which the connecting pipe 40 is not inserted is closed by the rubber stopper. However, it is possible to form the air passages 144 by only the necessary number for inserting the connecting pipes 160. For example, four base members 140 disposed at each of the four corners of the cushion are provided with two air passages 144 respectively. By this, it is possible to save the time and effort to close the air passage 144 with the rubber plug 161.

The above-mentioned cushion is used in the state it is being placed on the seating portion of a wheelchair. Also, the cushion has the area corresponding to the seating portion. The air cells 140 are filled with a certain amount of air. By this, if someone sit down on the wheelchair, the air pressures in the air cells 130 become equal level each other. Thus, by dispersing the pressure added to the sitting person's body, it is possible to prevent the generating of bedsore.

In this case, by setting up the size or the arrangement of the air cells 130 according to the sitting person's body shape, it is possible to disperse more effectively the pressure added to the sitting person's body. For example, if the size of the air cells 130 for supporting the buttocks and its neighborhood of the sitting person is different from the size of the air cells 130 disposed on the other position, it is possible to effectively reduce the pressure added to the sitting person's body. Since the air cells 130 are detachably attached on each base member 140, it is possible to arbitrarily set up the size or arrangement of the air cells 130.

The air cells 130 are made from soft rubber material or soft resin material for dispersing the pressure added to the sitting person's body. By this, the air cells 130 are easy to damage. About this situation, the air cells 130 are detachably attached on the base members 140. Thus, if the some air cells 130 are broken, it is possible to exchange only the broken air cells 130.

Moreover, since the air cells support the sitting person, it is desirable to always keep the air cells 130 in a clean state. About this situation, the air cells 130 are detachably attached on the base members 140. Thus, it is possible to take off and wash each air cell 130 respectively, and exchange some air cells 130 for new air cells 130.

The base members 140 are attached to the installation plate 150 respectively. Thereby, a positional deviation of each of the air cells 130 attached to each base member 140 does not arise easily.

Thus, according to the present embodiment, it is possible to arbitrarily set up the size or the arrangement of the air cells 130. Thus, it is possible to change the size or the arrangement of the air cells 130 on the wheelchair according to the sitting person's shape. Also, it is exceedingly advantageous for effectively dispersing the pressure added to the body.

Also, it is possible to arbitrarily change the material, hardness, etc. of the air cells 130. For this reason, the pressure added to the body can be distributed more effectively.

Furthermore, when some air cells 130 are broken, it is possible to exchange only the broken air cells 130. By this, it is possible to repair the air cells 130 easily and inexpensively.

Moreover, it is possible to take off each air cell 130 and to wash each air cell 130, it is also possible to exchange some air cells 130 for new air cells 130. By this, it is possible to easily wash the air cells 130, and exchange the air cells 130 according to the state of the air cells 130. Thus, it is exceedingly advantageous for always keeping the air cells 130 clean.

Also, a plurality of through-holes 151 are provided on the installation plate 150 so as to penetrate the installation plate 150 in the thickness-direction of the installation plate 150. When the second protrusion portions 143 of the base members 140 are inserted into the through holes 151 from one thickness-direction surface side to the other thickness-direction surface side of the installation plate 150 respectively, the base members 140 are attached to the installation plate 150. By this, it is possible to attach the base members 140 to the installation plate 150 easily and certainly, and the base members 140 can be attached and detached in a short time.

Also, the second protrusion portions 143 of the base members 140 project from the other thickness-direction surface of the installation plate 150. Moreover, the air passages 144 of the base members 140 are disposed at the other thickness-direction surface side of the installation plate 150, and the air passages 144 communicate with each other by the connecting pipes 160. By this, even when the air cells 130 are being disposed so as to be adjacent each other, the air passages 144 can be connected to each other easily and certainly. Thus, it is exceedingly advantageous for reducing work hours of connecting the air passages 144. If the air passages 144 and the connecting pipes 160 are disposed at the other thickness-direction surface side of the installation plate 150, there is the chance that deformation of the air cells 130 is restricted by the air passages 144 and the connecting pipes 160. However, in the present embodiment, since deformation of the air cells 130 is not restricted by the air passages 144 and the connecting pipes 160, it is exceedingly advantageous for dispersing the pressure added to the body. Furthermore, the ventilation passageway formed by connecting the air passages 144 by the connecting pipes 160 is not restricted by the air cells 130. Thus, it is advantageous for arbitrarily changing the ventilation passageway formed by connecting the air passages 144.

In the present embodiment, the installation plate 150 is formed in a uniform thickness size. However, it is possible to form a part of the installation plate 150 so as to be different in thickness compared with the other part of the installation plate 150. Also, it is possible to provide the base members 170, 171 according to the thickness of the installation plate 150, and provide the air cells 180, 181 according to the base members 170, 171 respectively. By this, the base members 130, 170, 171 are disposed so as to be arranged on a certain surface. Also, the air cells 130, 180, 181 are formed so that the top of the air cells 130, 180, 181 are positioned at the same height each other. By this, if the installation plate 150 is formed so that the thickness volume of the portion corresponding to the air cells 130 disposed near buttock is smaller than the thickness volume of the other portion, the air cells 130 disposed near buttock become higher. It is possible to reduce effectively the pressure added to the buttock that tends to become more high pressure than the other portion. It is possible to reduce effectively the pressure added to the buttock that tends to become higher pressure than the other portion. Thus, it is possible to disperse more effectively the pressure added to the body.

The preferred embodiments described in this specification are illustrative and not restrictive. The scope of invention is given by the appended claims, and all changes and modifications included in the meaning of claims are embraced in the present invention.

What is claimed is:

1. An air cell unit, comprising:

an air cell being capable of housing air, the air cell having at least one opening portion and having flexibility;

a base member defined by two thickness-direction surfaces connected to each other by an outer peripheral surface;

a protrusion portion provided on one of said thickness-direction surfaces of the base member so as to protrude from the one thickness-direction surface of the base member in the thickness direction, the protrusion portion having an outer surface on which an opening end part of the air cell is detachably attached by a fitting such that said opening end part of the air cell surrounds the protrusion portion;

at least one of a projection portion or a recessed portion provided on said outer peripheral surface of said base member and being protruded or recessed in the direction perpendicular to the thickness direction of the base member, wherein the projection portion extends laterally beyond said base member, the projection portion or the recessed portion for connecting the base member and another base member by being formed so as to connect with the other of a projection portion or a recessed portion of another base member when the base member and another base member are disposed on a flat direction so that their end portions in the direction perpendicular to the thickness direction are adjacent to each other;

an air passage provided in the base member, the air passage communicating air in the air cell that is attached to the base member via the opening portion, the air passage being capable of connecting with an air passage of another base member; and a pressing member for pressing the opening end part of the air cell toward the protrusion portion in a state in which the opening end part of the air cell is attached to the protrusion portion.

2. The air cell unit according to claim 1, wherein the air passage is formed so as to connect with the air passage of another base member by connecting the base member to another base member.

3. The air cell unit according to claim 1, wherein said pressing member is a generally annular member.

4. The air cell unit according to claim 1, wherein said base member is board-shaped.

5. The air cell unit according to claim 1, wherein said pressing member is a separate member that surrounds both the opening end part and the protrusion portion.

6. The air cell unit according to claim 1, wherein each of said base members includes both a projection portion and a recessed portion.

7. The air cell unit according to claim 6, wherein said projection portion and said recessed portion are located on opposite sides of said outer peripheral surface of said base member.

8. The air cell unit according to claim 6, wherein said projection portion and said recessed portion are located on the same side of said outer peripheral surface of said base member, such that said projection portion and said recessed portion are adjacent each other.

9. A cushion, comprising:

a plurality of air cells being capable of housing air, the air cells each having at least one opening portion and each having flexibility;

a plurality of base members each defined by two thickness-direction surfaces connected to each other by an outer peripheral surface;

a protrusion portion provided on each of the base members, the protrusion portion provided on one of said thickness-direction surfaces of the base member so as to protrude from the one thickness-direction surface of the base member in the thickness direction, the protrusion portion having an outer surface onto which an opening end part of the air cell is detachably attached by a fitting such that said opening end part of the air cell surrounds the protrusion portion, wherein said opening end part is integrally formed with the air cell, and is formed of the same flexible material as the air cell;

an installation plate having a larger area than the base member;

a plurality of first connecting portions provided on one thickness-direction surface of the installation plate;

a second connecting portion provided on each of the base members, the second connecting portions for detachably attaching the base members to the installation plate by connecting with the first connecting portions;

at least one of a projection portion or a recessed portion provided on said outer peripheral surface of said base member and being protruded or recessed in the direction perpendicular to the thickness direction of the base member, wherein the projection portion extends laterally beyond said base member, the projection portion or the recessed portion for connecting the base member and another base member by being formed so as to connect with the other of a projection portion or a recessed portion of another base member when the base member and another base member are disposed on a flat direction so that their end portions in the direction perpendicular to the thickness direction are adjacent to each other;

an air passage provided in each of the base members, the air passage for communicating air to/from the air cell which is attached to the base member via the opening portion, the air passage being capable of connecting with the air passage of another base member; and a pressing member for pressing the opening end part of the air cell radially inwardly toward the protrusion portion in a state in which the opening end part of the air cell is attached to the protrusion portion, wherein said pressing member is a separate member that surrounds both the opening end part and the protrusion portion.

10. The cushion according to claim 9, further comprising:

a connecting member disposed at said other thickness-direction surface side of the installation plate, the connecting member for mutually connecting air passages of the base members being attached to the installation plate.

11. The cushion according to claim 9, wherein the air cells are divided into a plurality of groups, a switching valve is provided, and the switching valve is capable of switching a ventilation passage formed by the air passages of the base members so as to communicate in the air cells only in a selected one or more of said groups.

12. The cushion according to claim 9, wherein said pressing member is a generally annular member.

13. The cushion according to claim 9, wherein said plurality of base members are each board-shaped.

14. The cushion according to claim 9, wherein each of said base members includes both a projection portion and a recessed portion.

15. The cushion according to claim 14, wherein said projection portion and said recessed portion are located on opposite sides of said outer peripheral surface of said base member.

16. The cushion according to claim 14, wherein said projection portion and said recessed portion are located on the same side of said outer peripheral surface of said base member, such that said projection portion and said recessed portion are adjacent each other.

17. A cushion, comprising:

a plurality of air cells being capable of housing air, the air cells each having at least one opening portion and each having flexibility;

a plurality of base members defined by two thickness-direction surfaces connected to each other by an outer peripheral surface;

a protrusion portion provided on each of the base members, the protrusion portions being provided on one thickness-direction surface of the base member so as to protrude from the one thickness-direction surface of the base member in the thickness direction, the protrusion portions each having an outer surface on which an opening end part of the air cell is detachably attached by a fitting such that said opening end part of the air cell surrounds the protrusion portion;

an installation plate having a larger area than the base member;

a plurality of through-holes provided on the installation plate so as to penetrate the installation plate in the thickness-direction, the through-holes being capable of detachably attaching the base members to the installation plate by inserting a part of the base member from one thickness-direction surface side to the other thickness-direction surface side of the installation plate and by fitting with said part of the base member;

an air passage provided in each of the base members, the air passage for communicating air to/from the air cell which is attached to the base member via the opening portion of the air cell and a concave portion of the base member, wherein the concave portion of the base member extends generally in the longitudinal direction of the base member and the air passage extends generally in the transverse direction of the base member, and further wherein the air passage is capable of connecting with the air passage of another base member; and a pressing member for pressing the opening end part of the air cell toward the protrusion portion in a state in which the opening end part of the air cell is attached to the protrusion portion, wherein, in the state in which the base member is attached to the installation plate, the air passage is located below the other thickness-direction surface side of the installation plate and the pressing member is located above the one thickness-direction surface side of the installation plate.

18. The cushion according to claim 17, further comprising:

a connecting member disposed at said other thickness-direction surface side of the installation plate, the connecting member for mutually connecting air passages of the base members being attached to the installation plate.

19. The cushion according to claim 17, wherein the air cells are divided into a plurality of groups, a switching valve is provided, and the switching valve is capable of switching a ventilation passage formed by the air passages of the base members so as to communicate in the air cells only in a selected one or more of said groups.

20. The cushion according to claim 17, wherein the base members each include a second protrusion portion that protrudes in the same direction as the protrusion portion.

21. The cushion according to claim 17, wherein said pressing member is a generally annular member.

22. The cushion according to claim 17, wherein said plurality of base members are each board-shaped.

23. The cushion according to claim 17, wherein said pressing member is a separate member that surrounds both the opening end part and the protrusion portion.

* * * * *